US005930970A

United States Patent [19]

De Le fevre

[11] Patent Number: 5,930,970

[45] Date of Patent: Aug. 3, 1999

[54] PANEL CONSTRUCTION USE AS A FORMING DEVICE FOR SETTABLE FLUIDS IN CONSTRUCTION

[76] Inventor: Patrick Y. De Le fevre, 225 Commonwealth Ave., Boston, Mass. 02116

[21] Appl. No.: 08/870,176

[22] Filed: Jun. 6, 1997

Related U.S. Application Data

[63] Continuation-in-part of application No. 08/818,136, Mar. 14, 1997, Pat. No. 5,833,872.

[51] Int. Cl.[6] ..... E04C 2/32

[52] U.S. Cl. ..... 52/630; 52/426; 52/789.1; 249/33; 249/40; 249/189

[58] Field of Search ..... 52/789.1, 630, 52/426; 249/33, 40, 189

[56] References Cited

U.S. PATENT DOCUMENTS

| | | | |
|---|---|---|---|
| 963,889 | 7/1910 | Goodwin | 52/630 |
| 4,150,808 | 4/1979 | Sawyer | 249/189 X |
| 5,399,406 | 3/1995 | Matsuo et al. | 52/630 X |
| 5,619,832 | 4/1997 | Myrvold | 52/630 X |

*Primary Examiner*—Christopher Kent
*Attorney, Agent, or Firm*—Robert K Tendler

[57] ABSTRACT

In a universal, reusable system for molding concrete or other settable fluids for use in building construction, an apertured composite plastic panel is provided for use in the framing system in which the plastic panel, rather than being of a honeycomb structure, includes a single face sheet which serves as a pour side surface, with an array of truncated pyramids having central apertures extending rearwardly from the back side of the sheet.

13 Claims, 24 Drawing Sheets

PANEL CONSTRUCTION USE AS A FORMING DEVICE FOR SETTABLE FLUIDS IN CONSTRUCTION

RELATED APPLICATIONS

This application is a continuation-in-part of patent application Ser. No. 08/818,136, filed Mar. 14, 1997 by Patrick De Le fevre and now U.S. Pat. No. 5,833,872.

FIELD OF INVENTION

This invention relates to construction of buildings and more particularly to a reusable panel for use in a frame system that provides a retaining structure for settable materials such as concrete.

BACKGROUND OF THE INVENTION

As described in patent application Ser. No. 08/818,136 filed Mar. 14, 1997, a frame system for providing reusable framing structures for settable materials such as concrete includes apertured panels which, when erected, form the mold surfaces for such settable materials as concrete. The utilization of these apertured panels and oversized plugs results in a self-aligning framing structure that permits the rapid erection of walls, floors and the like in which the panels and thus the walls are automatically trued. In one embodiment, the apertures in the panels are formed in a rectilinear array with the apertures equidistant one from the other.

As discussed in the aforementioned patent application, the panels are of a honeycomb structure in which there are two face sheets to either side of a honeycomb structure.

While these panels are suitable for use in the buttressed framing structure described in the above-mentioned patent application, they are somewhat heavy due to the number of sheets used to form the panel as well as the honeycomb structure itself.

It is important to note, that the panels themselves carry considerable loads when concrete is poured in between facing panels.

In the honeycomb environment, the structural rigidity derives from the coaction of the honeycomb structure with the front face and the back face of the panel, such that the panel itself resists bowing outwardly when the heavy concrete is poured into the mold formed by these panels.

There is therefore a need for providing a plastic apertured panel which can be of lighter weight, yet obtain the same or greater rigidity so as to resist the concrete pour during the pouring operation as well as providing rectilinear rigidity during the initial framing process.

By way of further background, and in order to describe the necessity for a reusable panel framing system for use in construction, in the past, it has been common to pour concrete into forming structures or molds made of wood or metal which are fastened together with nails or bolts on the job site. As early as the Pharoahs time, wooden panels have been oriented in a vertical direction, with settable material being poured in from the top and with panels being fixed together with nails or other such devices. In the present day, buildings are constructed by methods of utilizing panels made of either wood or metal to contain the concrete until the concrete sets. In general, these panels and the structures that hold them in place during the setting period have either been retained within the building or removed after the concrete or other settable material has set up.

The problem with forming settable walls and columns in this manner is that measurements must be taken each time the forming structures are fabricated on site, meaning that all of the edges and panels must be trued and vertical so that the walls or other structural members which result from the pouring of the concrete likewise come out with parallel sides and right-angled corners. In order to provide for the rectilinearity of the walls, skilled artisans must make complicated and precise measurements to assure proper placement and sizing of the resulting structural members. This oftentimes requires utilization of laser datum lines to make sure that the forming structures are appropriately oriented. Therefore, the utilization of traditional molds for settable concrete requires a highly skilled artisan. The skill relates both to experience in providing the required forming structures and also in minimizing the time necessary to construct these structures.

For instance, it takes a skilled artisan a relatively large amount of time to provide a suitable mold for construction of a wall and column combination. In addition, oftentimes it is the case that the frames and panels utilized in the fabrication of the mold out weigh the weight of the concrete to be poured. This requires the utilization of a large amount of man power and heavy machinery resulting in longer construction times. Furthermore, since the mold walls or panels and buttressing equipment are massive, precision molding is relatively difficult, which again warrants the utilization of experienced artisans.

For instance, when building columns or walls are to be erected, it sometimes takes a skilled artisan as much as five or six hours to provide a suitable mold for a wall and column combination. Another factor in the fabrication of molds for settable concrete is the shear weight or mass of the elements required to make up the mold. Oftentimes it is the case that the frame and panels utilized in the fabrication of the mold out-weigh all the concrete to be poured. For instance, the machinery necessary to buttress a wall on both sides to a distance of 10 feet high can be as much as 2–3 tons, whereas the wall itself, once having been fabricated, is less than 500 pounds.

Since the mold walls or panels and buttressing machinery are massive, precision molding is relatively difficult. It will be appreciated that high precision is required most notably in high-rise type of buildings, those buildings exceeding 20 stories. The precision is required because as one builds up from a base, any mistakes in the position of the wall at the base level affects higher stories of the building. As will be appreciated, it is very difficult to correct for mistakes made at a lower level when building walls at a higher level.

It will also be appreciated that when building molds for retaining concrete, removing nails and screws or bolts in order to effectuate a modification of the structure due to change of plans or other factors is virtually impossible. This is because in general the panels which are buttressed are not capable of being adjusted on the fly to accommodate changes of plan.

While in the past metal panels have been preformed to various panel sizes, the utilization of these panels is difficult in situations where modifications must be made on the spot to accommodate architectural changes or, in fact, to accommodate unforeseen circumstances during the construction of the building. When these panels are replaced with panels of different sizes or configurations, it is not always possible to have them aligned and placed appropriately.

It will be appreciated that the difficulty in aligning these panels stems from both the weight and the inability to dimension them properly. The reason for the requirement of a skilled artisan at this point is that the artisan must take dimensions over a number of diagonals and to calculate out the appropriate dimensions for the panel or the buttressing structure. Mistakes are often made in the on-site calculations, resulting in a formed wall that does not come out to specification. The result of a wall not meeting the specs is costly. Therefore, utilization of highly paid artisans is required to make sure that such an occurrence does not happen.

As described in the aforementioned patent application, rather than requiring a skilled artisan on-site to make the measurements for the panels and the buttressing structure, in order to provide the appropriate molds for the poured concrete or other settable material, in the subject invention, all of the framing members and panels are apertured in such a way that when dowels are used to join the members together, all of the panels and walls are automatically trued. In one embodiment, the apertures in each of the panels or framing members are in a rectilinear array, with the apertures equidistant one from the other. This means that alterations can be made on the spot, in the size or dimension of any building component, without having to remeasure the entire job.

In one embodiment, the apertured panels and framing members are prestressed by the presence of an array of removable and interchangable oversized plastic plugs in the apertures. When an oversized plug is inserted into an aperture, the plug deforms inwardly when in place, thus providing prestressing in that structural element.

Moreover, when members are joined together by connecting apparatus from oversized plugs in adjacent members, the members are accurately positioned due to the accuracies associated with the holes into which the oversized plugs are inserted. Thus, not only do the apertures or holes in the apertured members provide for initial truing, this truing is maintained due to the fact that the entire structure, when assembled, is stable and rigid.

In one embodiment, the members are made of light weight material, such as a composite plastic material made of different layers, with a honeycomb structure being preferable and with the honeycomb sandwiched between two exterior sheets. The sheet which is on the pour side of the panel can be patterned by merely providing the sheet with the appropriate pattern or design.

In operation, apertured base strips are laid out in a rectilinear fashion and screwed down into the foundation floor. This positions the apertures in each one of these base strips, such that when members are attached to these base strips through the utilization of the plastic dowels, the rectilinearity or dimensional stability of the resulting structure is maintained.

In one embodiment, apertured horizontal and vertical channels are laid and erected, respectively, on the top of the apertured base strip by the means of plastic dowels. The combination of these channels with base strips and dowels supports and positions the panels forming the walls of the pour and holds them in place both horizontally and vertically.

It will be appreciated that the apertured panels constitute the main component of the subject system. Note, these panels made of composite plastic materials are prestressed by the presence of an array of removable and interchangable oversized plastic plugs. These oversized plugs, in one embodiment, have an outwardly elliptical surface, such that when these plugs are forced into a member by pneumatic means, the plug shrinks imperceptibly as it goes through the hole. This being the case, the pressure between the outer surface of the plug and inner surface of each of the holes is increased such that the friction fit provides prestressing. Thus the utilization of the oversized plugs provides a structure which is rigid and dimensionally exact.

In one embodiment, the oversized plugs are removable, again by pneumatic means. Moreover, in one embodiment, the exterior surface of the plugs has a retaining sphere or bulb which snaps into place in the apertured members to maintain the plug in place. Note, the aperture into which the plug is placed is provided with mating cup-shaped holes into which the detents fit so as to determine the location of the plug within the aperture.

It will be appreciated that this is an all plastic system in which the plugs themselves are made of plastic. In order for the plug to be easily insertable and positioned within the apertures of the frames, it is important that portions of the plug engaging the walls of the aperture be flexible while other portions of the plug be rigid.

In one embodiment, the plug is provided with a central bore to permit devices to be secured to the plug and also to permit removal of the plug, such that the plug can be grabbed and pulled from the aperture. The bore is also utilized to accommodate interlocking plugs such that the various apertured members can be locked together at the plug. Alternatively, the plugs can be used by themselves simply as an anchoring device for mating structural elements.

In another embodiment of the plug, a circumferential annulus is provided in the bore such that when it is time to remove the plug, a gun-carried device is utilized to penetrate the bore of the plug and to pull out the plug by coaction with the annulus in the wall of the bore. In order to accomplish this, the bores are given a square or rectangular cross-section, such that a tool can be inserted around a round bolt passing through the square bore so that it can grab the plug at the aforementioned annulus while still being insertable to either side of the round bolt.

In another embodiment, the vertical channels for the wall panels are hingable, with the angle of the walls being set by inwardly projecting overlapping apertured tabs or base strips, with the angle being set by the overlying holes and the dowels therethrough. Thus the walls can be oriented at any desired angle.

In a further embodiment, removable conduits for the placement of wires, pipes and the like can be attached to the panels at the plugged apertures, whereas in another embodiment, apertured composite plastic frames are provided to brace the panels either from a floor base strip or from a ceiling frame, which also like the panels, are prestressed by the plugs and are made of composite plastic material.

In summary, a universal reusable system is provided for molding concrete or other settable fluids for use in building construction. In the subject system, apertured composite plastic panels and frames, prestressed by the presence of an array of removable and interchangeable oversized plastic plugs, are positioned and held in place by a framing system which utilizes a combination of apertured strips used as base guides and both vertical and horizontal channels, as well as dowels and plugs. The use of apertured panels and framing system provides for a reusable assembly whose dimensions can be readily set on site for each application and whose rectilinearity is maintained either by the dowel-aperture combination or by a combination of oversized plugs in adjacent members to be joined and connectors therebetween.

While the reusable nature of the plastic frame and panel structure permits economic fabrication of concrete walls, and at the same time assuring that the walls are true due to the overlapping of mating holes in the overlapping apertured members and the use of plastic dowels through the overlapping holes, lighter weight strong panels are required.

SUMMARY OF THE INVENTION

In order to provide lighter and more economical panels, in a universal, reusable system for molding concrete or other settable fluids for use in building construction, an apertured composite plastic panel is provided for use in the framing system in which the plastic panel, rather than being of a honeycomb structure, includes a single face sheet which serves as a pour side surface, with an array of truncated pyramids having central apertures extending rearwardly from the back side of the sheet.

In one embodiment, the pyramids are eight-sided truncated pyramids located in spaced adjacency on the back side of the sheet with plug retaining inserts interspersed between the pyramids. The result is a reusable apertured panel which can be readily erected through the utilization of removable interchangable oversized plastic plugs positioned in the apertures in the panel.

The result of utilizing a non-honeycomb plastic panel having the array of truncated pyramids both reinforces the sheet and provides structures into which oversized plugs maybe inserted, while at the same time minimizing weight and construction cost. The subject panel derives its extraordinary strength from the simulated corrugation provided by the array of truncated pyramids such that the weight of similar sized panels can be reduced by a factor of two over its honeycomb equivalent.

The structural rigidity and strength of the sheet is in part provided by integral ribs or spacers between adjacent edges of four adjacent truncated pyramids such that with the interposition of the spacers oppositely directed truncated pyramids are produced. The truncated pyramids, being of opposite directions, provide an alternating structure, both in the horizontal and vertical directions, such that pyramids of alternating directions are arranged in both of these directions as well as on any diagonal.

The oppositely directed array of truncated pyramids provides for easy nesting and stacking and panels for shipment, whereas as the pour side of the panel is smooth since inserts in the sheet have surfaces which are flush with the face of the panel to provide a smooth pour side surface. In order to accomplish this, in one embodiment, inserts are pressed into apertures provided by the truncated pyramids, with the insert being captured by the interior of the pyramid such that the pour side surface of the panel is smooth.

BRIEF DESCRIPTION OF THE DRAWINGS

These and other features of the subject invention will be better understood in conjunction with the Detailed Description taken in conjunction with the Drawings of which.

DETAILED DESCRIPTION

Figure 1:
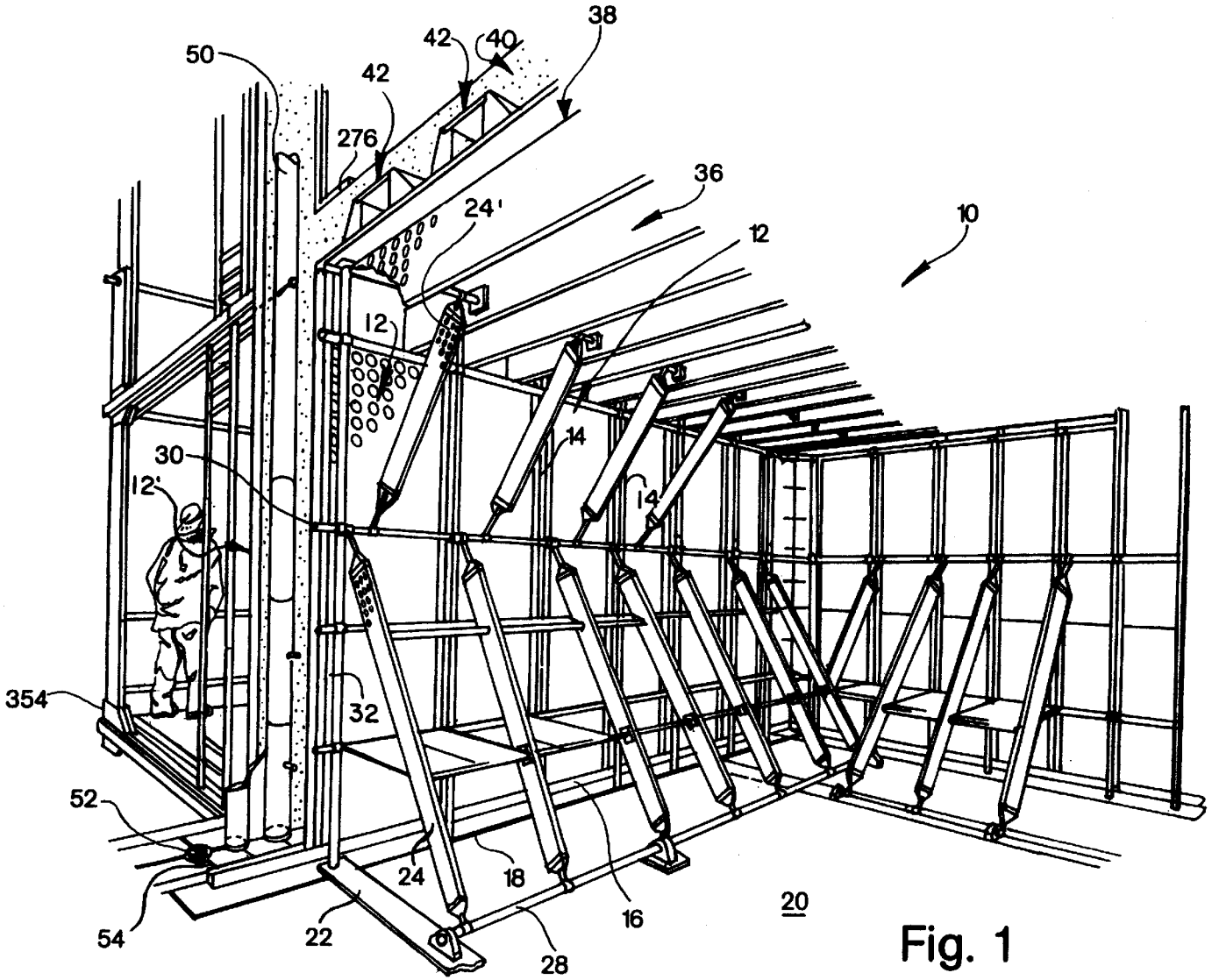
FIG. 1 is a perspective view of the subject removable forming system for the molding of concrete walls or the like in which all forming members are apertured prestressed members, with the prestressing due to the utilization of oversized plastic plugs.

Prior to describing the subject panel, referring now to FIG. 1, a removable all-plastic forming system 10 for the molding of settable materials such as concrete includes apertured plastic members, with the apertures having oversized plastic plugs therein to prestress each of the members. The primary forming member is a composite plastic panel 12 which is located in vertical channels or guides 14, with the bottom of each panel residing in a horizontal base channel or guide 16.

Horizontal base channel 16 is located on a base strip 18, with the base strips being initially laid out over a slab 20 in a rectilinear arrangement as illustrated by base strip 18 and base strip 22.

Panels 12 are buttressed by braces 24 running between a pipe 28 anchored to base strip 22 and a horizontally running pipe 30 coupled to a upstanding support pipe 32. Braces 24 also extend upwardly as illustrated at 24' to a horizontally running apertured plastic frame 36 which is used to support horizontal forming panel 38 for supporting an upper floor. The upper floor is formed as a concrete slab 40, which in one embodiment is a waffle slab produced by trapezoidal pans 42.

The initial wall is poured between panels 12 and 12' which form the mold for the wall.

As is usual during construction, vertically running conduits 50 are used in forming cavity walls or housing utility lines. In this case, the conduits are supported at their base by cups 52 and their spacers 54.

It will be appreciated that all of the forming members are joined together through dowels or plugs in the various apertures such that the rectilinearity of the forming structure is assured without remeasuring every time a member is put in place. The only initial measurements are those made by screwing down the base strips to the foundation floor slab. Because the apertures are in an equally spaced rectilinear array through all of the members, securing one member to another through the aperture/dowel structure assures truing of the walls both in a horizontal and vertical direction, a task which herebefore has not been possible without the utilization of skilled labor.

As mentioned hereinbefore, when forming concrete or settable structural elements, skilled labor is required to dimension each of the mold parts for that element. Note that the measurements must be made on the diagonal as well as the vertical and horizontal directions. In the subject invention, these members and panels are secured together via dowels at respective apertures such that merely assembling one on another and mating the members through the utilization of the dowels and apertures assures truing of the walls without complicated measurements or skilled labor. Moreover, the forming structures are light weight and dimensionally accurate due to prestressing with oversized plugs.

Figure 2:
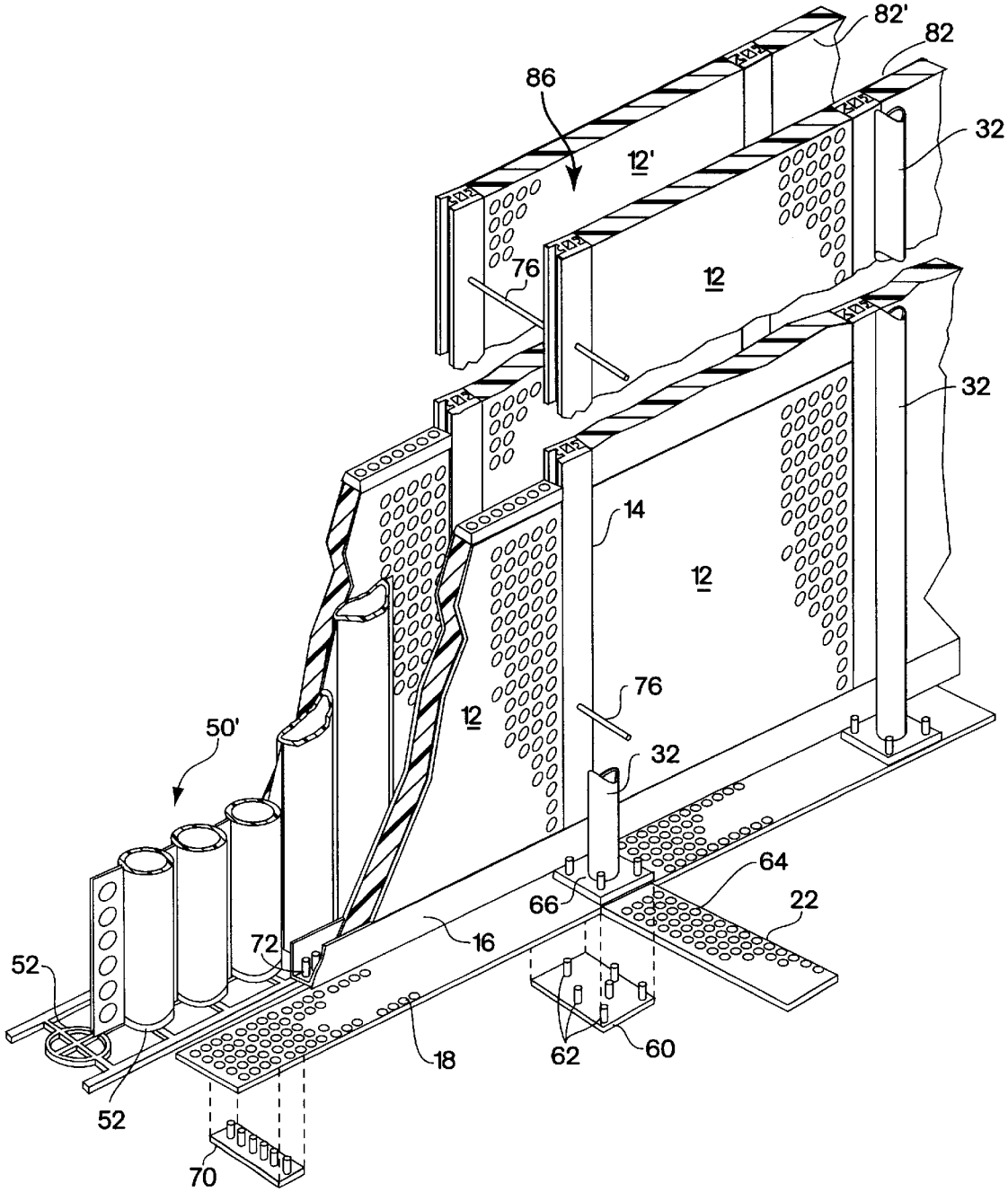
FIG. 2 is an isometric and a cross-sectional view of a portion of the system of FIG. 1 showing the joining of apertured base strips with horizontal and vertical channels which support and position the panels and hold them in place through utilization of dowels.

Referring now to FIG. 2, in the embodiment shown in FIG. 1, apertured base strip 22 is joined to a rectilinearly located base strip 18 through the utilization of a combination connector 60 having upstanding dowels 62 as illustrated. These dowels project upwardly through apertures 64 in base strips 18 and 22 so as to attach them together, with the dowels also attaching a base plate 66 at the base of support pipe 32 to the base strip, likewise to locate the support pipe with respect to the base strip.

Moreover, strip connectors 70 have upstanding dowels 72 which project upwardly into apertures in base channel 16 to locate the base channel with respect to the base strip. As can be seen, composite panels 12 are located in channel 16 such that dowel 72 locates the base of panel 12 in the corresponding orthogonal directions. As will be seen, dotted dowel 62 locates vertical channel 14 on base strip 18 such that this channel as well as the adjacent channel 14' are located precisely with respect to the base strip.

It will be noted that panel 12' and panel 12 are tied together through laterally extending rods 76 which serve to orient the vertical channels and thus the panels in parallel spaced adjacency. It will also be noted that these rods are conveniently provided through apertures in the vertical channels so that panel 12' can be aligned with panel 12 through the utilization of these rods.

As can be seen, cement or concrete is poured into the space between two panels 12 and 12' as indicated by arrow 80, such that the pour sided walls 82 and 82' of the adjacent panels provide the mold walls for settable materials.

If it is desired to have internal vertical conduits, these conduits can be provided in an array of plastic pipes as illustrated at 50', and are joined together such that their bases 86 are captured in cups 52.

Figure 3:
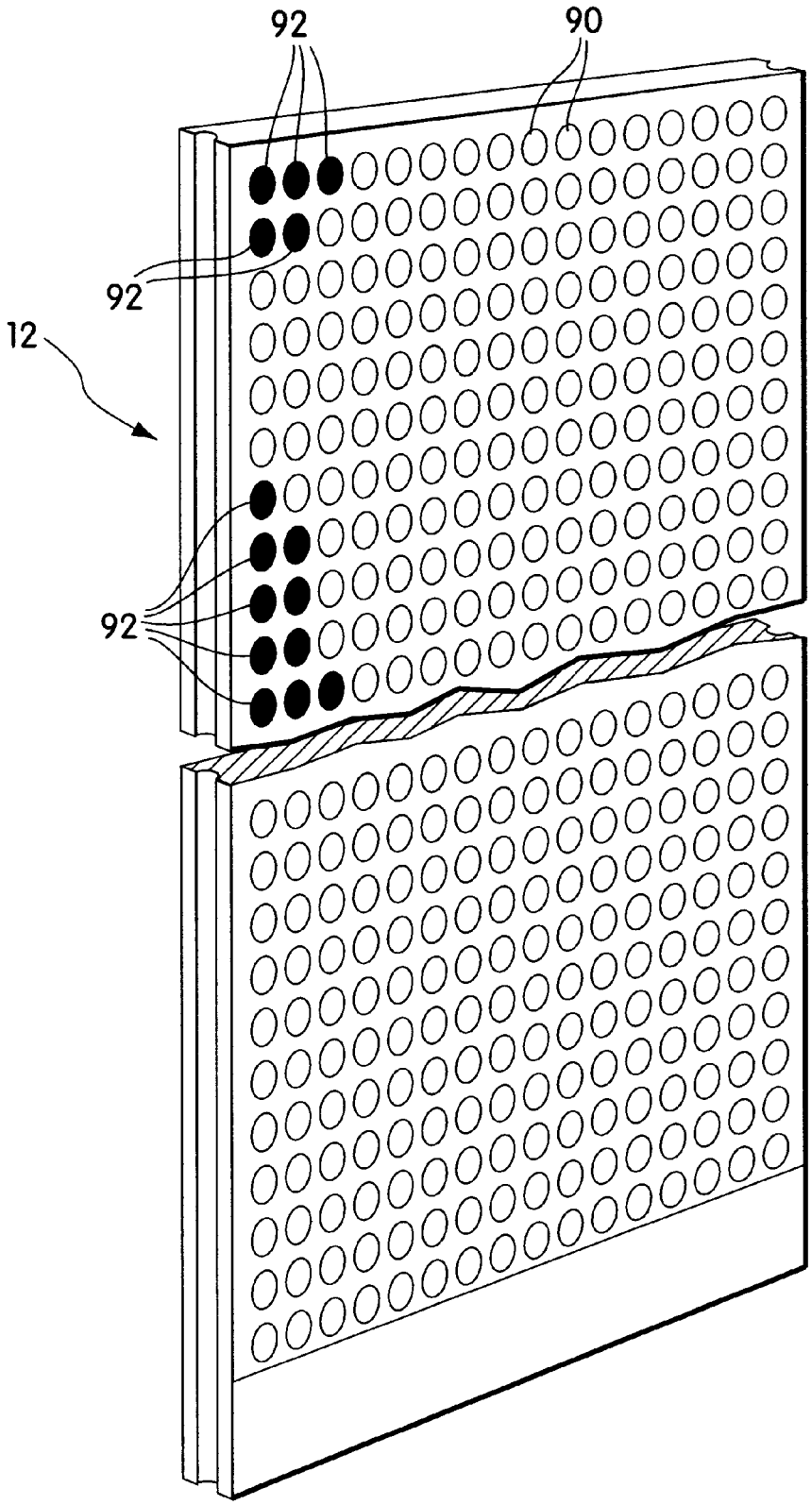
FIG. 3 is a front view of an apertured prestressed panel for use in the system of FIG. 1.

Referring now to FIG. 3, panel 12 is provided with a regular array of apertures 90 into which are inserted a variety of oversized plugs as illustrated at 92. In one embodiment, these plugs are oversized and made of plastic, which when they are inserted into the apertures provide for the aforementioned prestressing of the panels.

Figure 4:
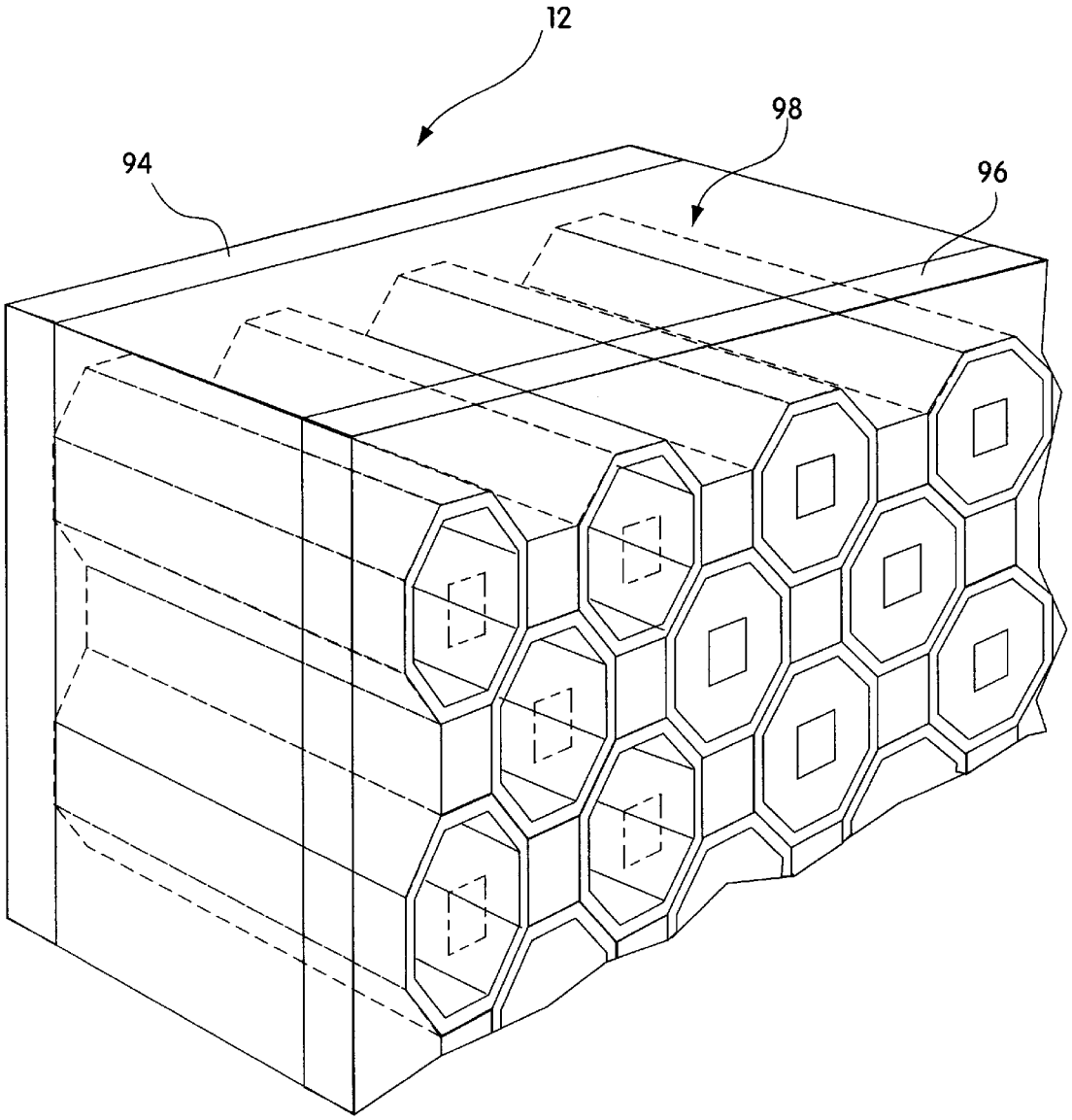
FIG. 4 is a diagrammatic and cross-sectional view of the panel of FIG. 3 illustrating the composite construction in which honeycomb members are disposed between face sheets.

Referring to FIG. 4, as to panels 12, these panels have a honeycomb structure with outer sheets 94 and 96 joined together with an intermediate structure 98 that comprises, in one embodiment, a plastic honeycomb.

Figure 5:
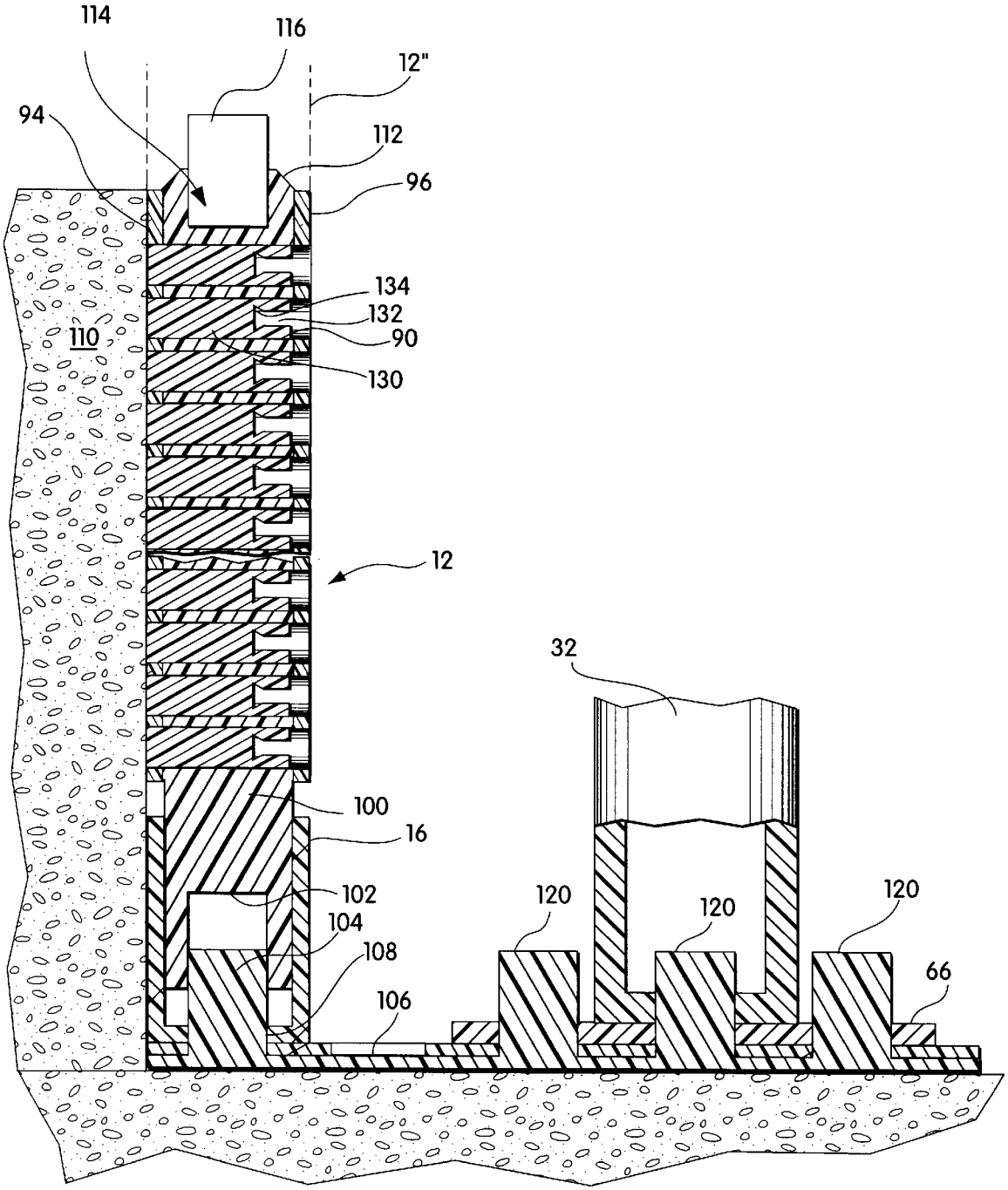
FIG. 5 is a diagrammatic and cross-sectional illustration of the panel of FIG. 3 in place on a horizontal base channel which is located through the use of upstanding dowels from a base strip, with the dowel locating a support pipe for the panel and frame, and with the uppermost part of the panel having apertures to receive dowels for locating the panel thereabove.

Referring now to FIG. 5, a cross-sectional view of panel 12 is illustrated in which the panel is seen inserted into a horizontal base channel or guide 16, with the lower portion 100 of panel 12 having bore 102 into which a dowel 62 through base strip 18 or 22 projects. It is noted that the base channel 16 also has an aperture 108 through which dowel 62 projects as well, thereby locating not only the base channel, but also the panel within the channel.

It will be seen that concrete 110 is poured between side 94 and the opposing forming wall, whereas the top portion 112 of panel 12 has an aperture 114 into which a positioning dowel 116 is inserted. This dowel is utilized to locate the upper panel 12' shown by the dashed lines.

Likewise, base strip 18 has upstanding dowels 62 which project up into apertures in base plate 66 integrally formed with support pipe 32 such that dowels 62 serve to locate the base and center of the support pipe.

It will be noted that panel 12 is provided with universal plugs 92 which have a bore 132 flanged at its interior most portion 134, with these plugs being inserted into apertures 90. It is the purpose of the flanged bore in the plug to provide an annular that permits removal by the insertion of a suitable tool to pull the plug outwardly. Likewise, bores 132 can be utilized to secure another forming member to the panel or wall.

Figure 6A:
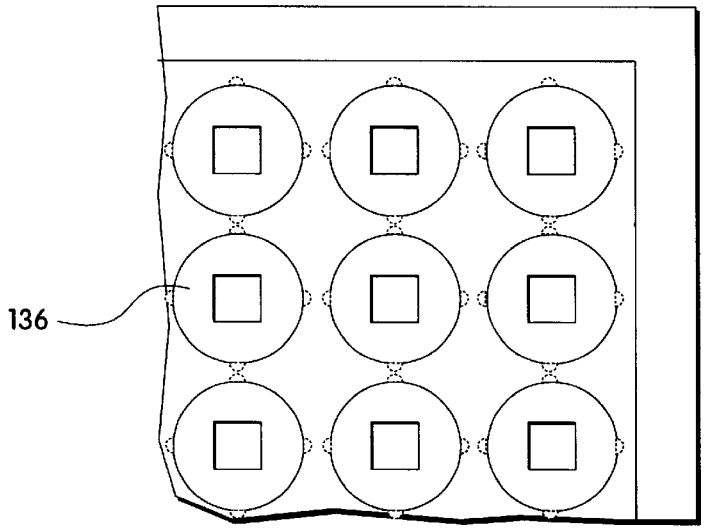
FIGS. 6A, 6B and 6C are diagrammatic illustrations of the various plug/aperture configurations for use in the panel of FIG. 3, illustrating a round, octagonal and hexagonal configurations.
Figure 6B:
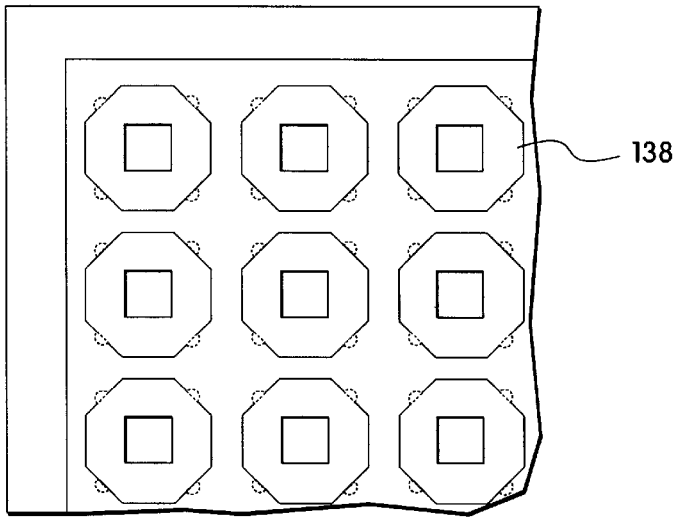
Figure 6C:
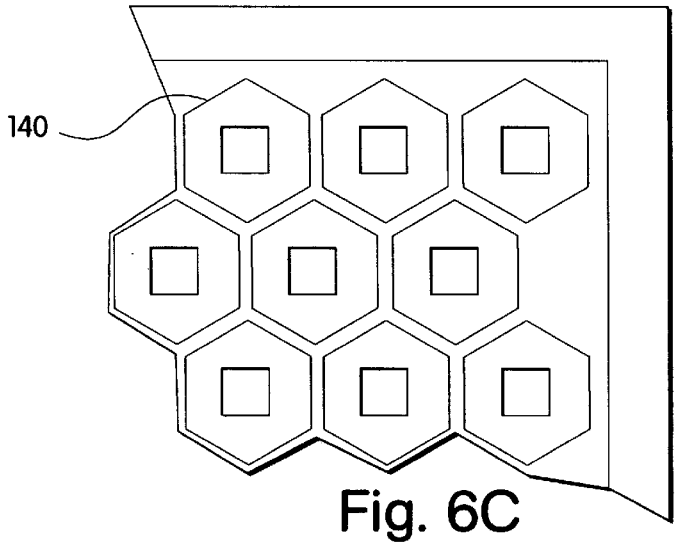

Referring now to FIGS. 6A, 6B and 6C, it can be seen that the apertures in honeycomb 98 can be given a round cross-section as illustrated at 136, an octagonal cross-section as illustrated at 138, or a hexagonal cross-section as illustrated at 140.

Figure 7:
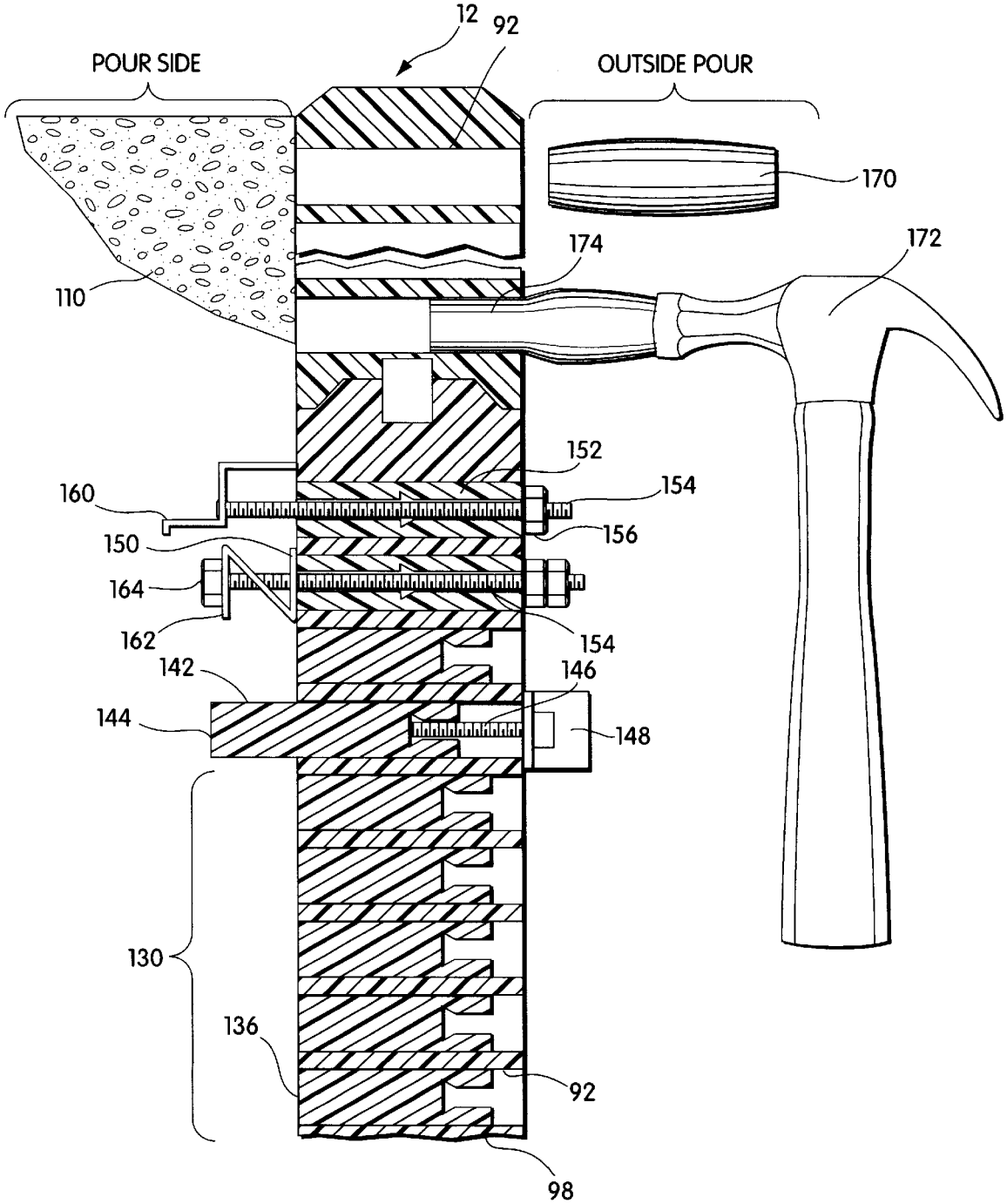
FIG. 7 is a cross-sectional and diagrammatic illustration of the panel of FIG. 3 illustrating the utilization of universal plugs, pour side connection plugs, and anchor plugs which are inserted into the apertures of the panel, with the removable and interchangable oversized plug providing the prestressed structure.

Referring now to FIG. 7, as to the type of plugs that can be inserted into apertures 90 and honeycomb 98, it can be seen that universal plugs 92 are useful in combination with the rest of the panel to provide a smooth surface or barrier as illustrated at surface 136 which causes the pour side wall of panel 12 to be able to retain concrete 110.

By extending the universal plug to the left as illustrated at 142, one has an inside pour connection plug 144 that extends into the pour for the connection of members within the concrete to the plug. It will be seen that pour connection plug 144 can be removed via a screw 146 having a nut and handle 148 so as to be able to position the plug or to remove it.

As illustrated at 150, anchor plugs may be provided which have a central bore 152 going completely therethrough. Here, a bolt 154 is positioned within bore 152 and is adjusted via nut 156 so as to position anchor member 160 located thereon. Obviously, there are various types of anchor members such as illustrated at 160 and 162 which may be secured to bolt 154 via an appropriate nut 164.

It will be appreciated that connecting devices 160 and 162 can be utilized to join adjacent members together, with apparatus from one oversized plug in one member coupled to apparatus at an oversized plug in an adjacent member.

For instance, it is possible to attach a door frame to a panel utilizing anchors in adjoining members, with the anchors being the oversized plugs and the connectors carried by the oversized plugs. Also, as will be discussed, scaffolding can be connected to a panel in the above manner.

Since the oversized plugs are themselves accurately located, the joining together of members using connectors at the plugs accurately positions one member with respect to the other. As such, the members may be accurately positioned one to the other either through the use of dowels or through the use of mating connectors at adjacent oversized plugs, or both.

Central to the utilization of the deformable plastic plugs is the notion that the outside diameter of a plug, here illustrated at 170, is greater than the inside diameter of aperture 90. When this plug is forced into the aperture as illustrated by hammer 172, the plug necks down, as illustrated at 174, such that the exterior walls of the plug coact with the interior walls of the apertures to stress the member. The prestressing, which is a result of utilizing oversized plugs, provides for a rigid, stable and light weight panel member.

The dimensional accuracy of all of the forming members, be they panels, base strips, channels, frames, etc. is assured by the utilization of the aperture/plug combination.

Figure 8:
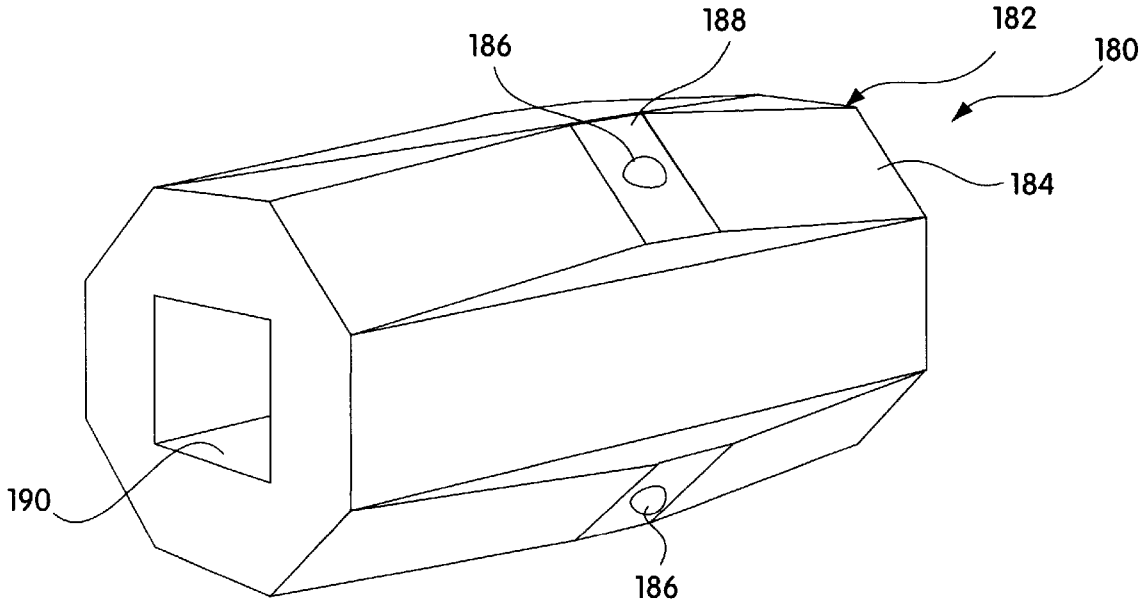
FIG. 8 is a diagrammatic representation of an octagonal plug construction, with outwardly extending ribs having detents thereon and with the plug carrying a central bore having a square cross-section.

Referring now to FIG. 8, in one embodiment, an oversized plug 138 is illustrated having a central octagonally shaped body portion 182 and upstanding ribs 184, with upwardly projecting detents 186 projecting from central flats 188. It will be appreciated while the central core of the plug may be relatively rigid, in order for the necking down of a plug in an aperture, ribs 184 can be made of a more flexible material as compared to the detents 186. Note that the apertures into which the plugs fit may be provided with detent-receiving depressions or cups so that the plug will be centered in the aperture. In this embodiment, a central bore which is square in cross-section is provided in each plug as illustrated at 190.

Figure 9:
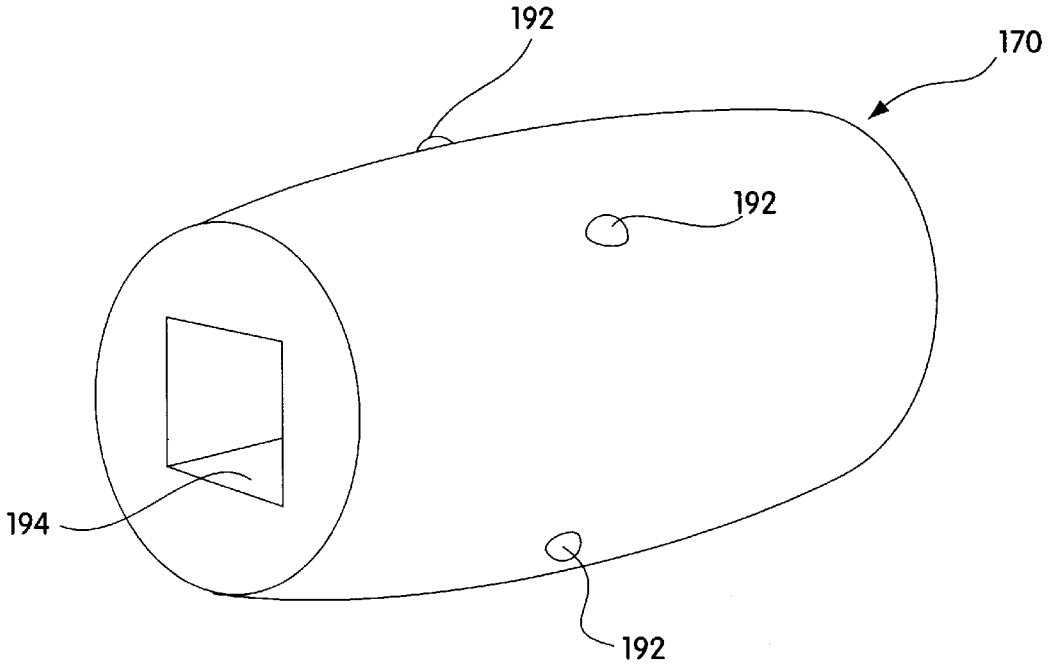
FIG. 9 is a diagrammatic illustration of a cylindrical plug having exterior detents and a central bore having a square cross-section.

Referring to FIG. 9, plug 136 may take on a cylindrical configuration as illustrated, with detents 192 outwardly projecting from the surface of this plug. Likewise, a square cross-section bore 194 is provided in this plug.

Figure 10:
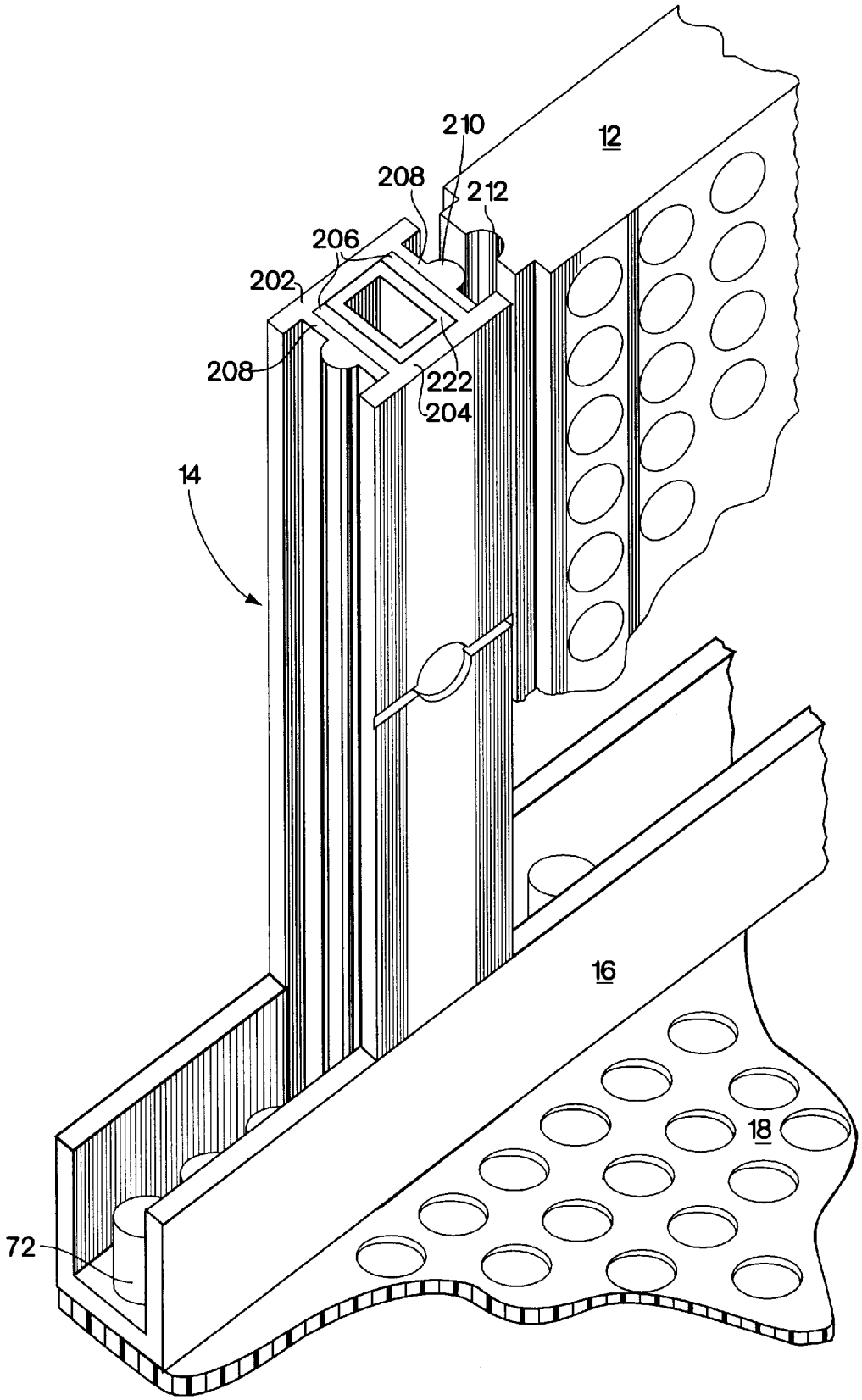
FIG. 10 is a diagrammatic illustration of one embodiment of the vertical channel of FIG. 1 for the location of a panel, indicating its location on a base strip with adjacent horizontal base channels, as well as its composite construction with a tongue and groove structure for mating with a vertically extending edge of a panel.

Referring now to FIG. 10, it will be appreciated that the panels can be inserted into the vertical and horizontal base channels, with the panels being removable along with the channel once the concrete is set.

It will also be seen that the panels can be snapped out of their vertical channel due to the unique composite construction of the channel. As can be seen from FIG. 10, vertical channel 14 is made up of outer and inner T-shaped portions 202 and 204. Inner T-shaped portion 204 has inwardly projecting rigid parallel walls 206, whereas outer T-shaped member 202 has inwardly projecting flexible walls 208. When the two T-shaped portions are in place, the inner walls are inserted into the outer walls to spread them.

It will be noted that walls 208 have a vertically running rib 210 adapted to coact with a mating slot 212 in panel 12. It will also be noted that vertical channel 14 is located on base strip 18 inside the horizontal channel 16.

Figure 11:
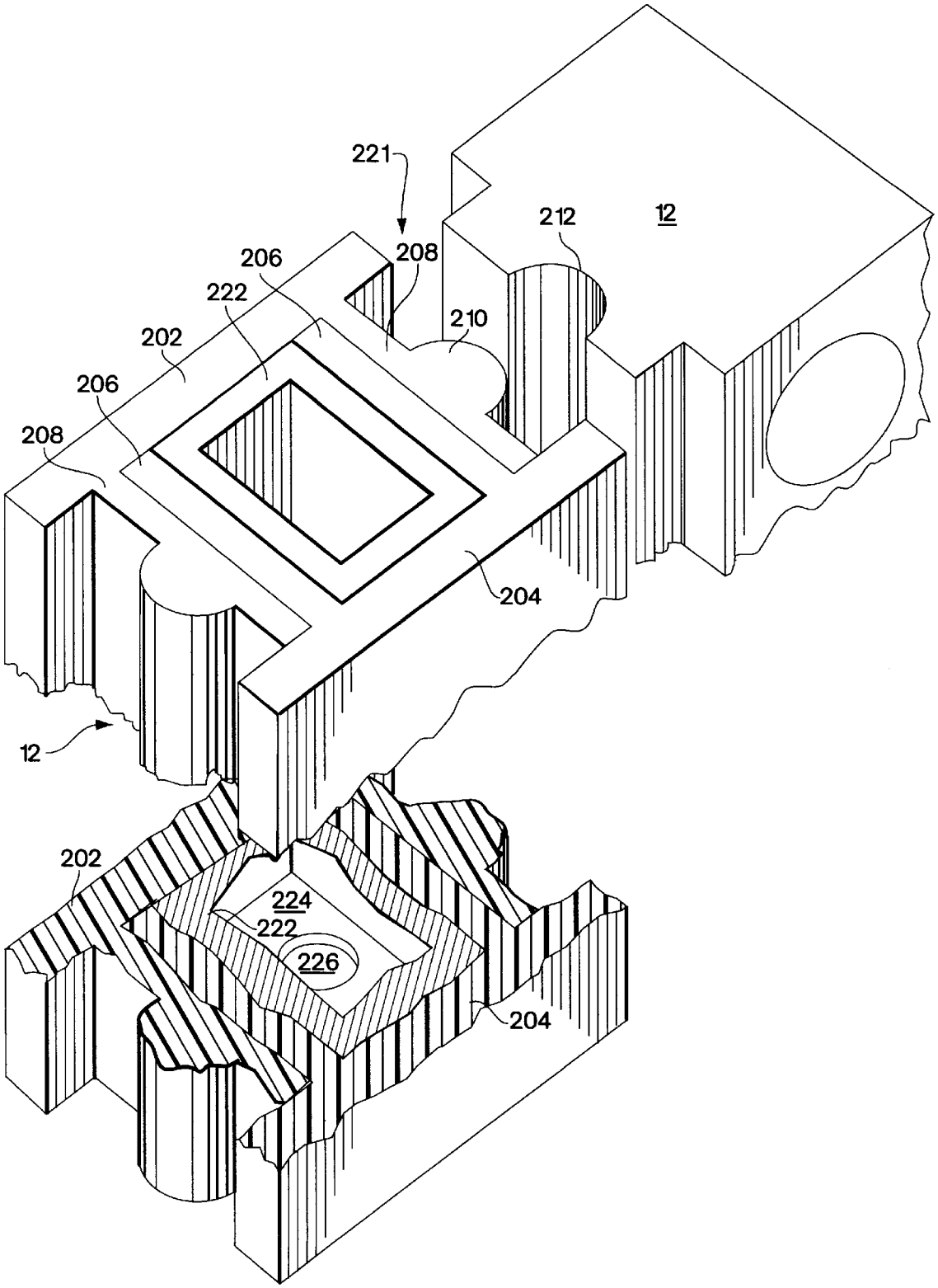
FIG. 11 is a cross-sectional and diagrammatic illustration of the vertical channel of FIG. 10 illustrating the composite construction of the channel and a central reinforcing member sandwiched between two T-shaped members.

Referring now to FIG. 11, details of the vertical guide are illustrated. Here, it can be seen that T-shaped portion 202 and T-shaped portion 204 have their inwardly projecting walls 206 and 208 mating such that when the two T-shaped portions are pressed together and in place, a groove 221 exists to receive panel 12.

It will be seen from this diagram that an interior metal stiffener 222 may be utilized to stiffen the resulting channel, with stiffener 222 having an apertured base 224, with aperture 226 therein adapted to receive an upstanding dowel from an adjacent base strip.

Figure 12:
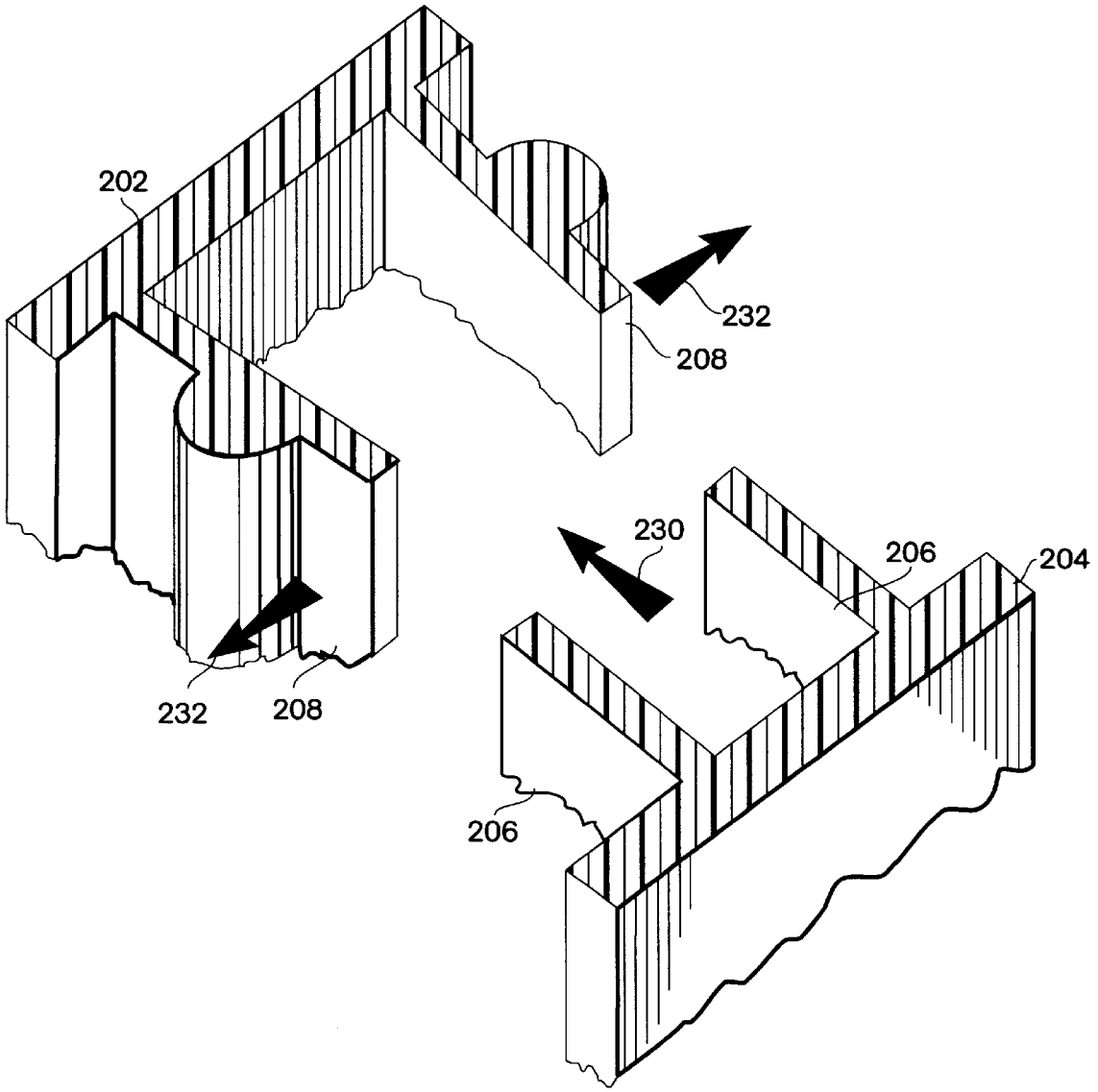
FIG. 12 is a diagrammatic illustration of the assembly of the two T-shaped portions of the vertical channel of FIG. 11 to make up the completed channel, illustrating that the insertion of the inner T-shaped portion into the outer T-shaped portion moves inwardly disposed walls of the outer portion outwardly, such that the walls of the outer portion are parallel.

Referring now to FIG. 12, it can be seen that walls 208 depending from T-shaped portion 202 are initially canted inwardly when formed. When T-shaped portion 204 has its wall 206 inserted in between walls 208 as illustrated by arrow 230, then walls 208 move outwardly as illustrated by arrows 232.

Figure 13:
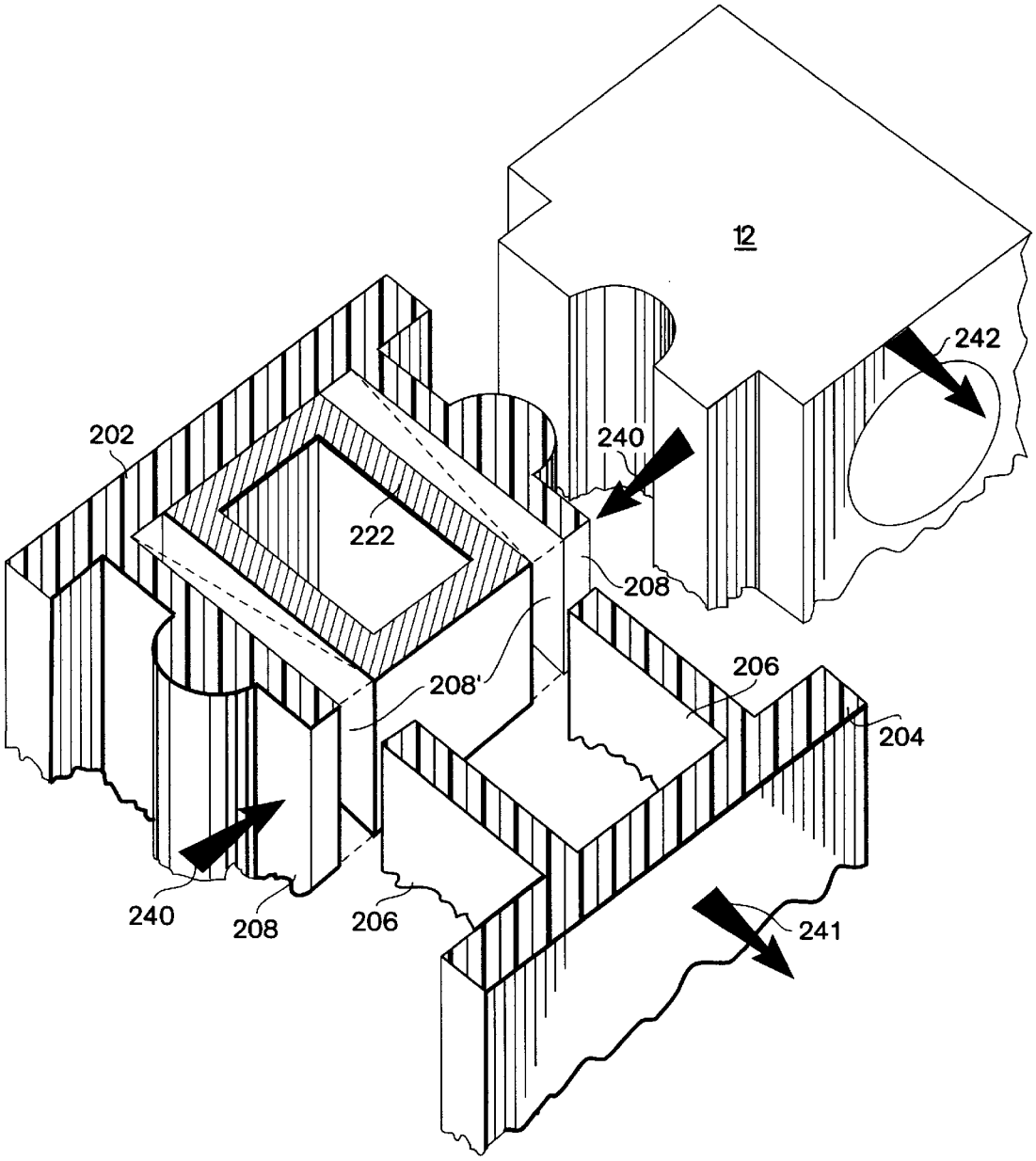
FIG. 13 is a diagrammatic and cross-sectional view of the removal of the inner T-shaped portion so as to permit inward flexing of the walls of the outer T-shaped portion to permit panel removal.

Referring now to FIG. 13, with the removal of T-shaped portion 204 in the direction of arrow 241, walls 208 move inwardly as illustrated by dotted outline 208' and arrows 240.

The inward movement of walls 208 permits the ready removal of panel 12 as illustrated by arrow 242, such that the panels making up the forming elements can be readily removed after the concrete wall has set.

Figure 14:
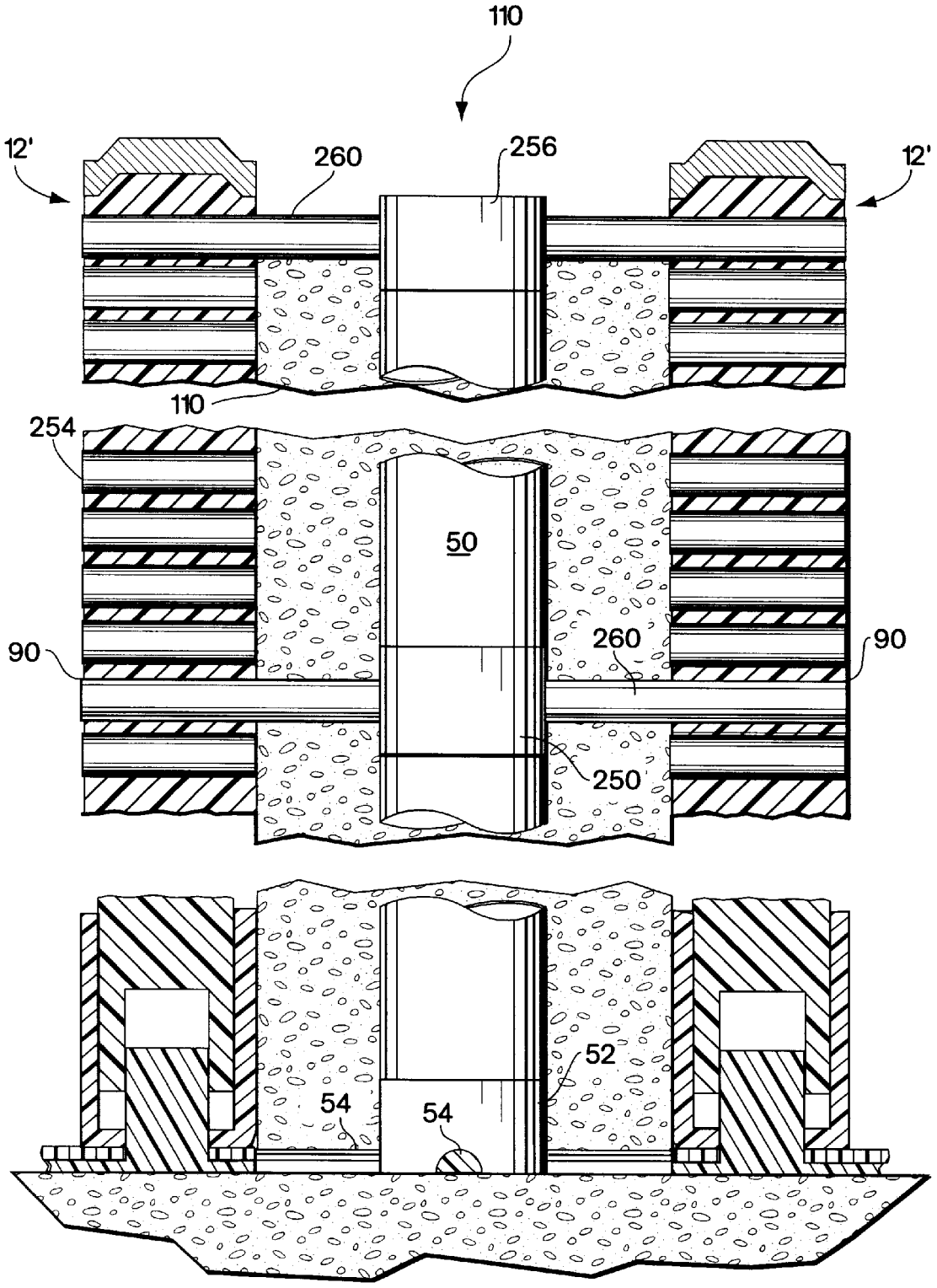
FIG. 14 is a diagrammatic illustration of the location of an interior pipe to be embedded within a concrete wall, with the pipe supported at a base cup and intermediately along the length of the pipe through a collar and ties extending into the apertures of the opposed panels making up the forming walls for the mold, with an array of these pipes placed to form cavity walls within the structure.

Referring now to FIG. 14, it will be appreciated that internal pipes 50 of FIGS. 1 and 2 can be located within concrete 110 through the utilization of the aforementioned cups 52 which are joined to adjacent structure via the aforementioned spacers 54 as illustrated.

What is shown here is the connection of an intermediate sleeve or cup member 250 which is joined to adjacent panels 12 and 12' via spacer bars 260 which project into apertures 90 in the corresponding wall.

It can thus be seen that the conduit 50 can be provided with a bottom cup 52, an intermediate sleeve or cup 250 and a top cap 256, with these cups and caps being positioned between the forming walls precisely through the utilization of the apertured wall structure and respective spacer bars.

Figure 15:
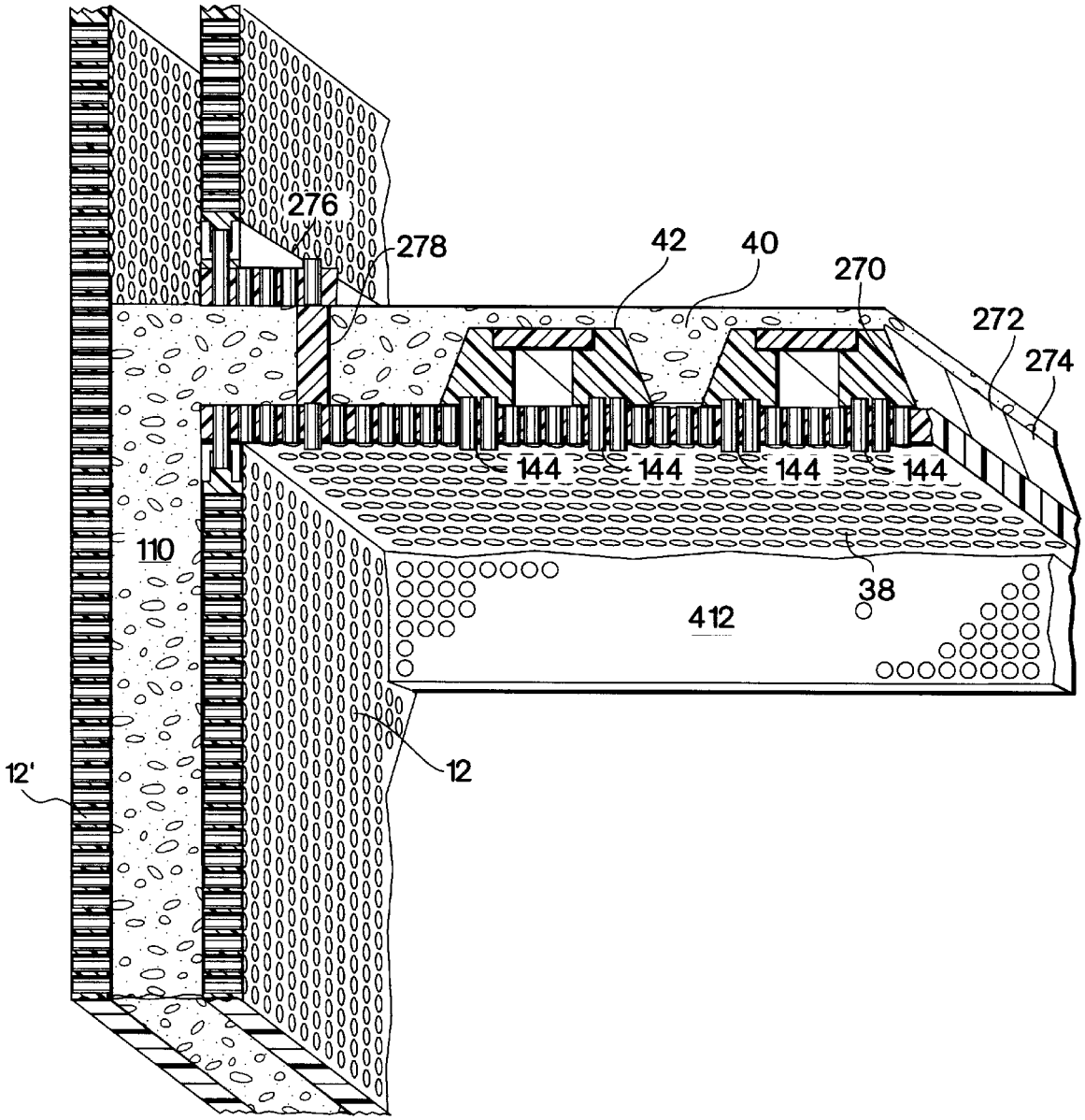
FIG. 15 is a cross-sectional and diagrammatic illustration of the formation of a waffle slab above a previously formed floor, illustrating the location of plastic trapezoidal pans through the utilization of dowels or plugs through an apertured plastic horizontally-disposed forming member.

Referring now to FIG. 15, it is possible to provide an upper floor concrete slab, here shown as waffle slab 40, through the utilization of an apertured member 38 which forms the bottom mold part for the floor. Member 38 is positioned on upstanding panel 12 as illustrated, with dowels 144 being used to locate plastic trapezoidal pans 42 in a rectilinear manner across member 38. The location of the plastic pans, which in one embodiment include adjoining members 270, 272 and 274 is made easy through the utilization of the apertured floor forming member 38.

Note also that an upper base strip 276 can be spaced from member 38 through the utilization of a spacer 278 such that the upper concrete floor can be poured in a dimensionally accurate manner with removable plastic forming members.

Figure 16:
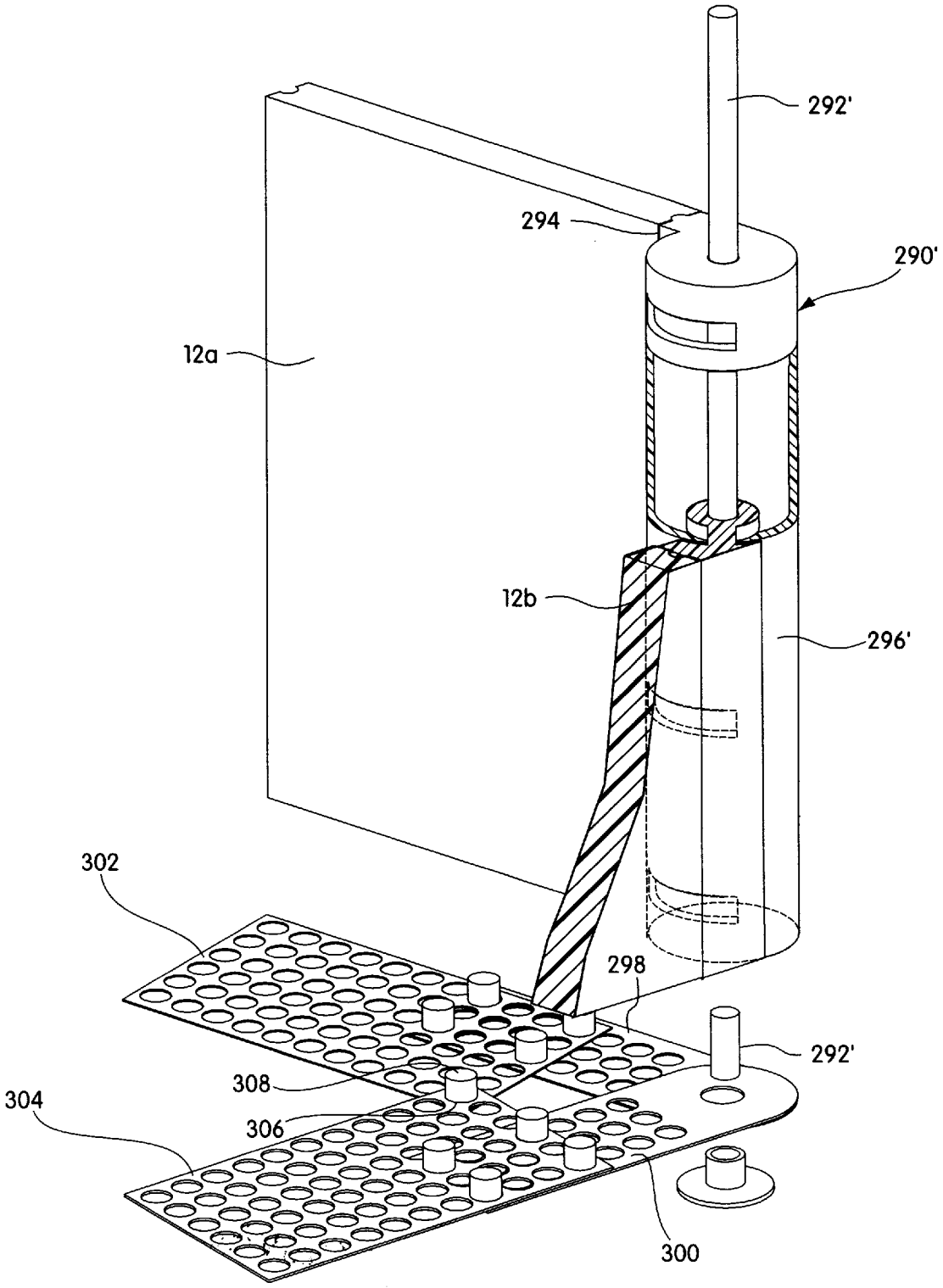
FIG. 16 is a diagrammatic illustration of the utilization of hinged vertical channels, with the hinge and apertured base strips permitting the formation of concrete walls at any predetermined angle, with inwardly disposed apertured tabs from each of the base strips being pinned together at an overlying aperture to fix the angle between the formed walls.

Referring now to FIG. 16, the utilization of apertured forming members includes the ability to place the resulting walls at any desired angle. In this embodiment, a vertical channel 290 is provided with an internal hinge rod 292 about which channel guides 294 and 296 pivot. Each of these channels has associated with it an apertured tab 298 and 300, with each of these being an extension of base strips 18 and 18'.

It will be appreciated that the angle between the walls can be set by overlying apertures 306 in the overlapping base strip positions 18 and 18', with the angle being set through the utilization of a dowel 308 through a selected aperture to maintain the angle between the base strips and thus the angle between the guides, which in turn defines the angle between the panels here shown at 12A and 12B.

During the erection of panels, it is oftentimes required to have a scaffolding which is buildable in an upward direction as the panels are completed and put in place. As can be seen from FIG. 17, a scaffolding 350 is made up of apertured frames 352 which fit into receiving guides 354 that are also utilized with a scaffolding arm 360 to secure horizontal flooring plates 356 on which an individual 358 can stand.

Guide 354 is located on a horizontal and inwardly running adjustable scaffolding arm 360 which is in turn anchored to the concrete wall through an aperture in panel 12. The building of a scaffolding is modular, as is the production of the forming members, such that as the forming members grow upwardly with the concrete having been poured there between, the scaffolding is likewise put in place through the anchoring of the scaffolding arm 360 through the utilization of a plug 366 that projects into an anchor 370 in the wall through an aperture in panel 12.

Figure 17:
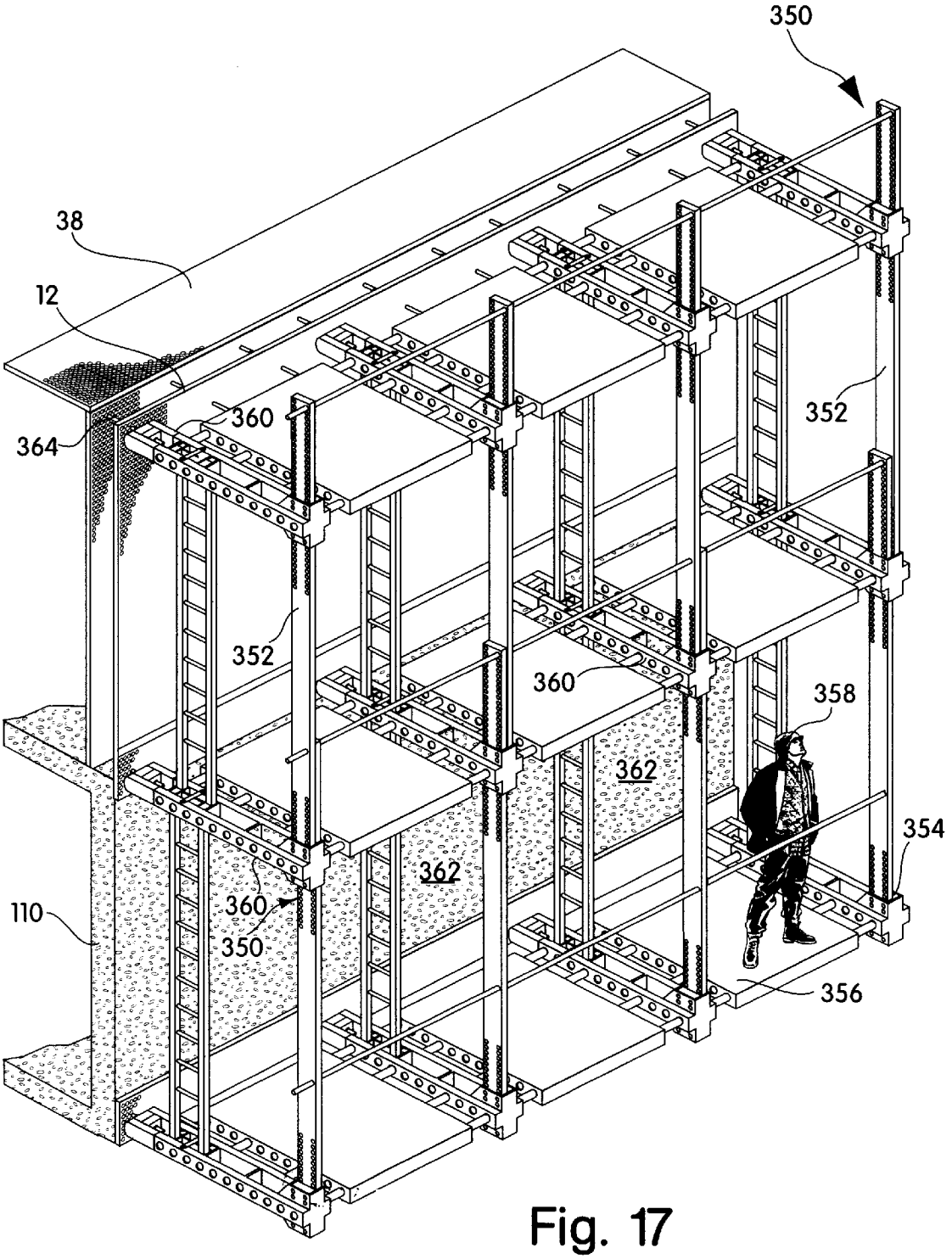
FIG. 17 is a diagrammatic illustration of the attachment of scaffolding to the apertured members of FIG. 1, with the scaffolding being secured to a wall via anchored bolts through the plugs in the associated panel.
Figure 18:
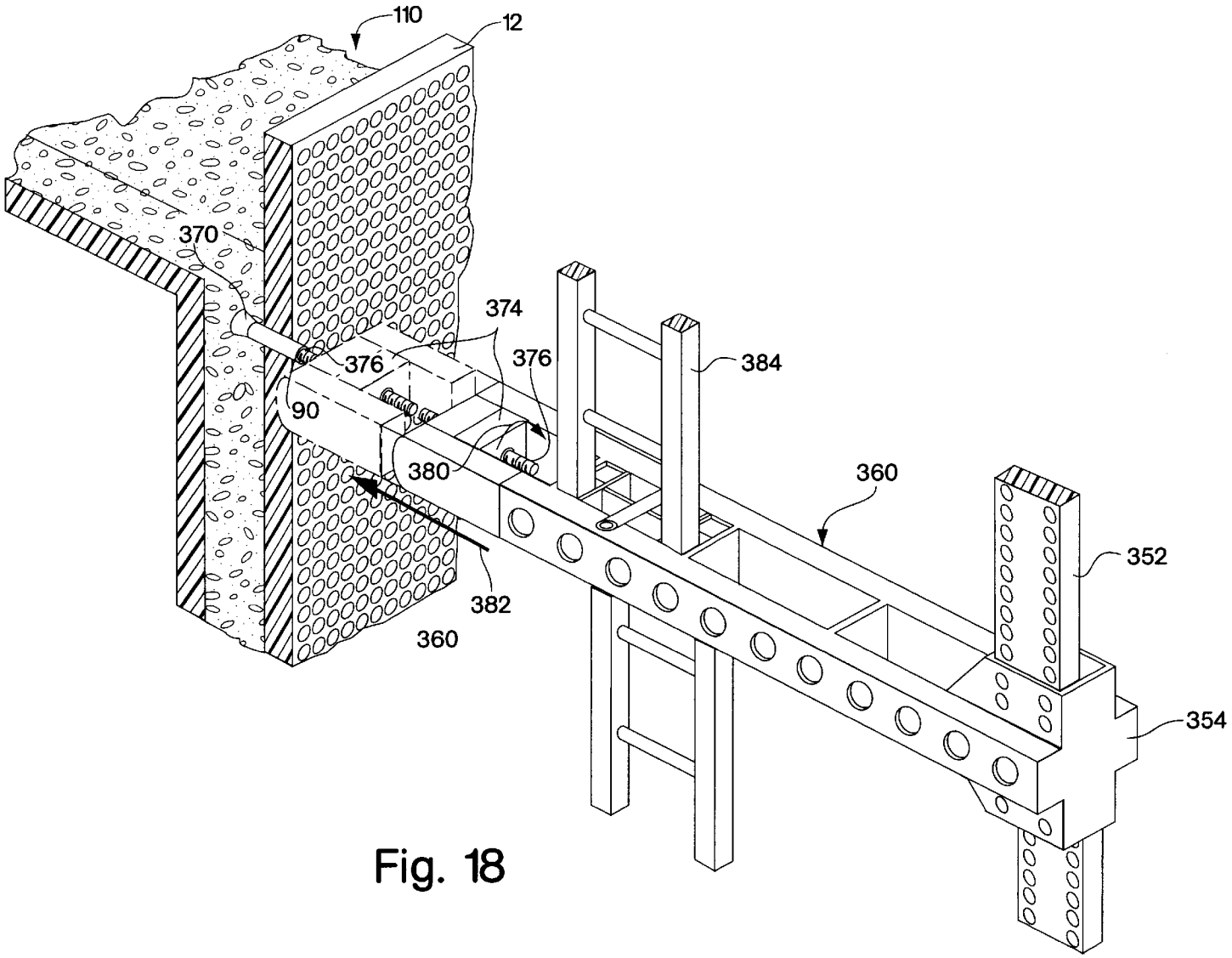
FIG. 18 is a diagrammatic illustration of a portion of the scaffolding of FIG. 17, with a scaffolding arm adapted to be secured to a plug through an aperture of the adjacent panel to the wall by the rotation of a bolt through a collar within the arm of the scaffolding.

Referring now to FIG. 18, scaffolding arm 360 includes collar 374 at its distal end. The arm 360 supports not only apertured frames 352 as illustrated in FIG. 17, it also is utilized to accommodate a ladder 384 to permit workers to move up and down the scaffolding. It is through the use of this arm that scaffolding can be readily attached to the walls through forming panels to provide a convenient method for erection of the integrated formwork. This anchoring structure is shown in detail in which wall 110 carries an anchor 370 described hereinbefore, having already been pressed into a corresponding aperture 90 in panel 12.

Scaffolding arm 360 is provided with a threaded collar 374 through which a threaded bolt 376 projects into an aperture 90 in anchor 370. By rotation of bolt 376 in the direction of arrow 380, scaffolding arm 360 is drawn towards wall 110 in the direction of arrow 382.

Figure 19:
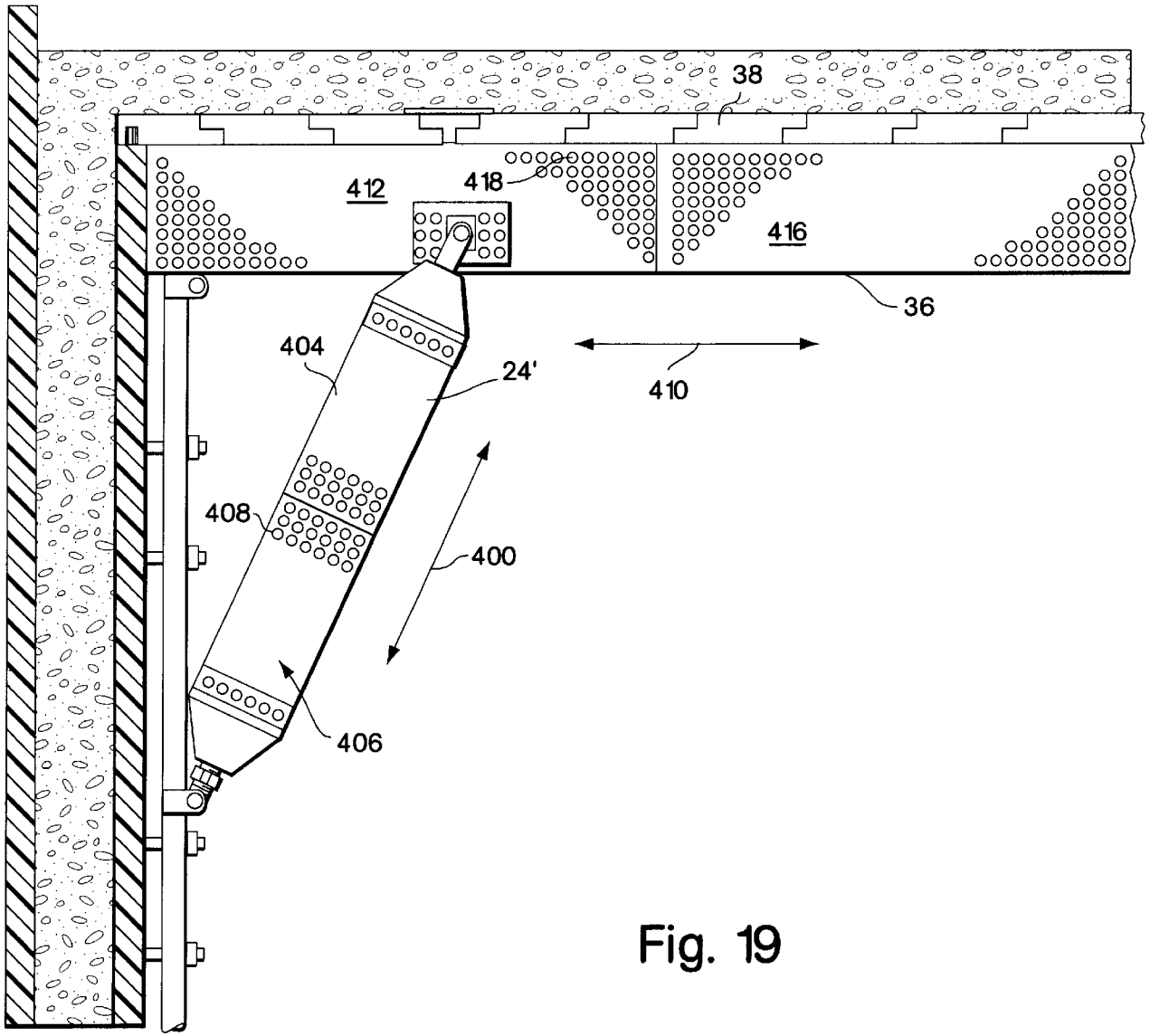
FIG. 19 is a diagrammatic illustration of the extensible nature of a brace and a support beam due to the overlapping of apertures within each of the members, with the apertures carrying dowels to provide the securing of one overlying member to the other.

Referring now to FIG. 19, it will be appreciated that since all of the members in the removable system described above are apertured, their lengths can be adjusted as illustrated by double-ended arrow 400, at least as so far as brace 24 is concerned. Here, brace 24 has overlapping members 404 and 406 likewise having overlying apertures 408. It will be appreciated that once the length of the brace is fixed, dowels project through the mating or overlying members 404 and 406 to lock in the particular dimension required.

Likewise, as illustrated by double-ended arrow 410, apertured frame 36 has overlapping members 412 and 416 which can be extended or contracted with respect to each other through the utilization of overlying apertures generally indicated at 418 such that these members, and in fact joining plates as illustrated at 38, can be utilized to set the dimensions for the forming structure.

It will be appreciated that through the utilization of apertured forming members a modular system is provided in which the dimension of the resulting structure can be tightly controlled without the utilization of skilled artisans or the utilization of measurements. Here the dimensional accuracy is guaranteed through the plug/aperture system.

Figure 20:
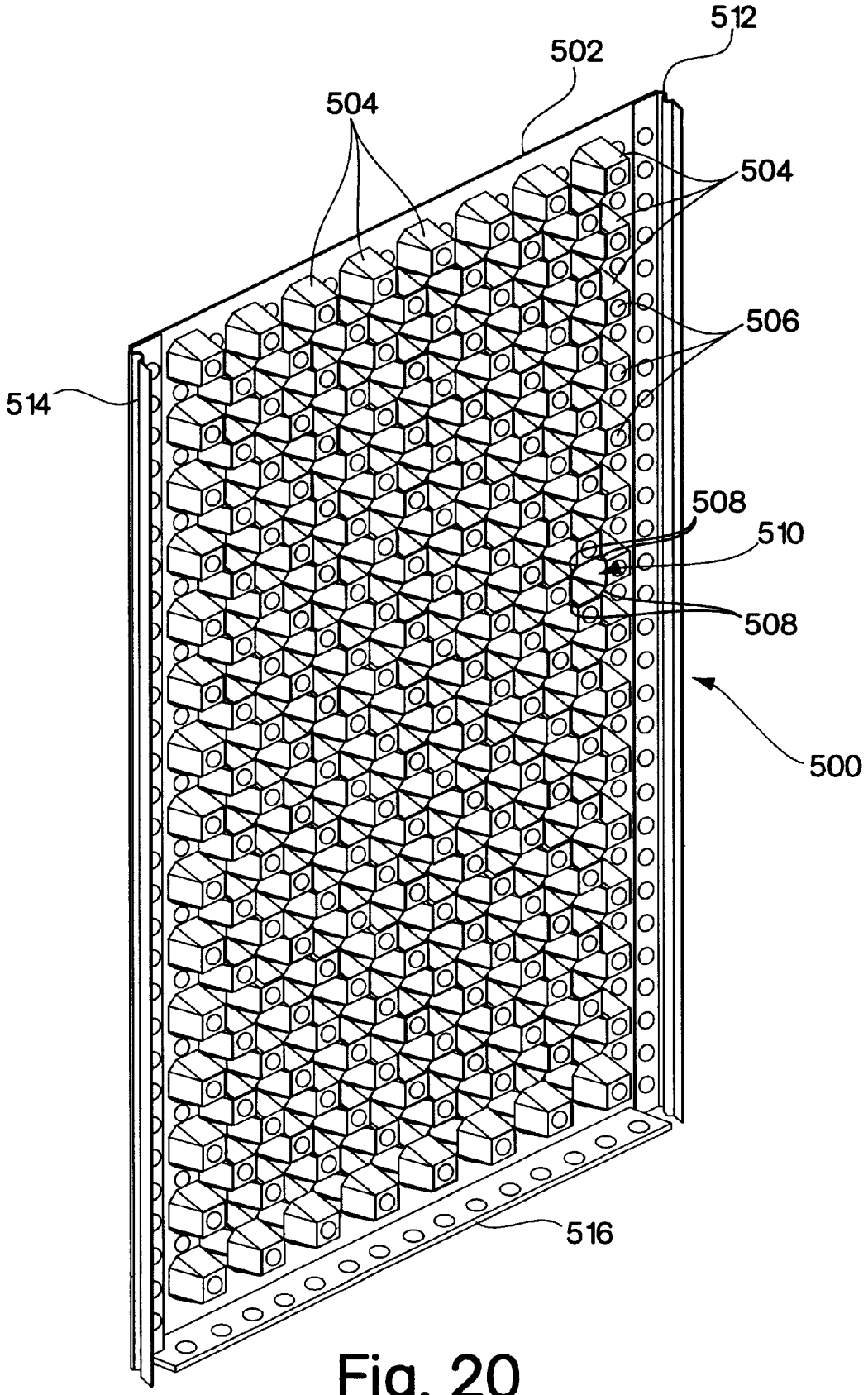
FIG. 20 is a front view of the back side of the subject reusable plastic panel showing a truncated pyramid array for panel reinforcing, illustrating alternating oppositely directed truncated pyramids with apertures therethrough.

Referring now to FIG. 20, in the subject system a light weight rigid panel 500 is substituted for panel 12 of FIGS. 1 and 2 and more particularly for the honeycomb structure shown in FIG. 4. As can be seen, panel 500 includes a single sheet 502 having arrayed thereon a series of truncated hollow, plastic pyramids 504 arrayed rectilinearly as illustrated. Each of the hollow, plastic pyramids 504 includes an aperture 506 adapted to receive the aforementioned oversized plugs. Each of the four adjacent truncated pyramids are joined together by integral ribs 508 such that the resulting structure formed thereby is an inverted pyramid structure illustrated at 510.

In the embodiment shown in FIG. 20, the pyramids 504 are eight-sided truncated pyramids, with the inverted pyramids 510 also being inverted eight-sided pyramids.

At the outboard edges of panel 502 there are angles 512 and 514 which serve to attach panel 500 to the adjacent vertical channels. Also shown in FIG. 20 is an upstanding base angle or side 516 which serves as the base of the panel for insertion into a lower channel of the frame.

As mentioned hereinbefore, this interlocking truncated pyramid structure provides the panel with light weight, while at the same time enough structural rigidity to withstand the forces on the pour side of the panel from buckling the panel. Also, the rectilinearity is preserved by this pyramid array.

Figure 21:
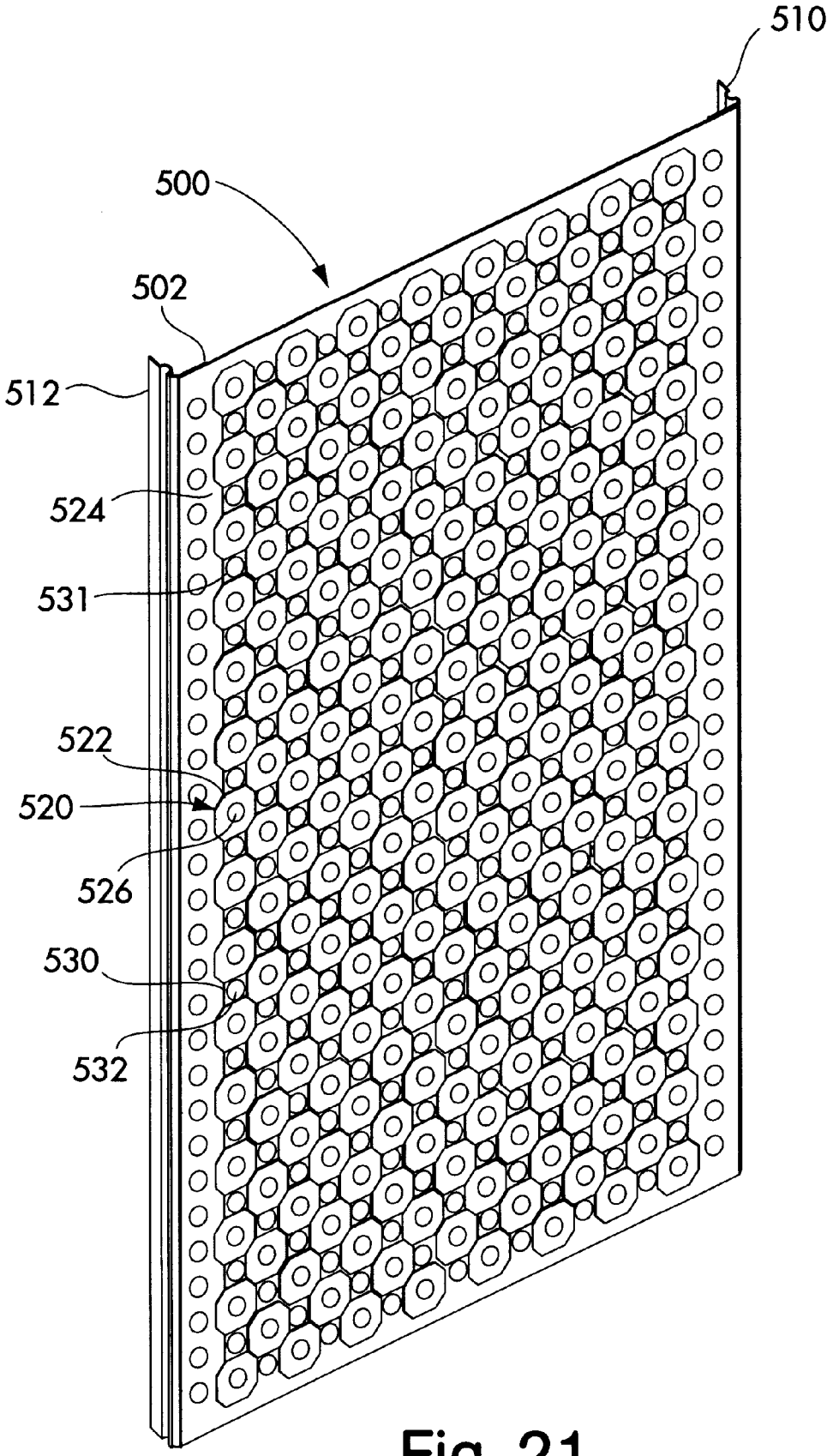
FIG. 21 is a front view of the pour side of the subject reusable panel showing a flush structure to provide a smooth molding surface.

Referring now to FIG. 21, the pour side of sheet 502 is shown, with that which is illustrated corresponding to the pour side of panel 500. Here it will be seen that because the pyramids are hollow, an insert 520 may be placed in a corresponding pyramid such that the face 522 of insert 520 is flush with the face 524 of sheet 502. As will be appreciated, insert 520 is apertured, with a plug 526 having its face flush with face 524 when inserted from the back side into the associated pyramid.

In between each of the inserts is a further plug 530 which is inserted into apertures 531 of panel 500 from the backside thereof. Plug 530 is also locked into place such that face 532 of plug 530 is likewise flush with face 524.

The assemblage of the plugs into the pyramidally formed panel provides an overall surface of the face which is smooth such that face 524 can be utilized to mold the concrete or like moldable material with a relatively flat face.

Figure 22:
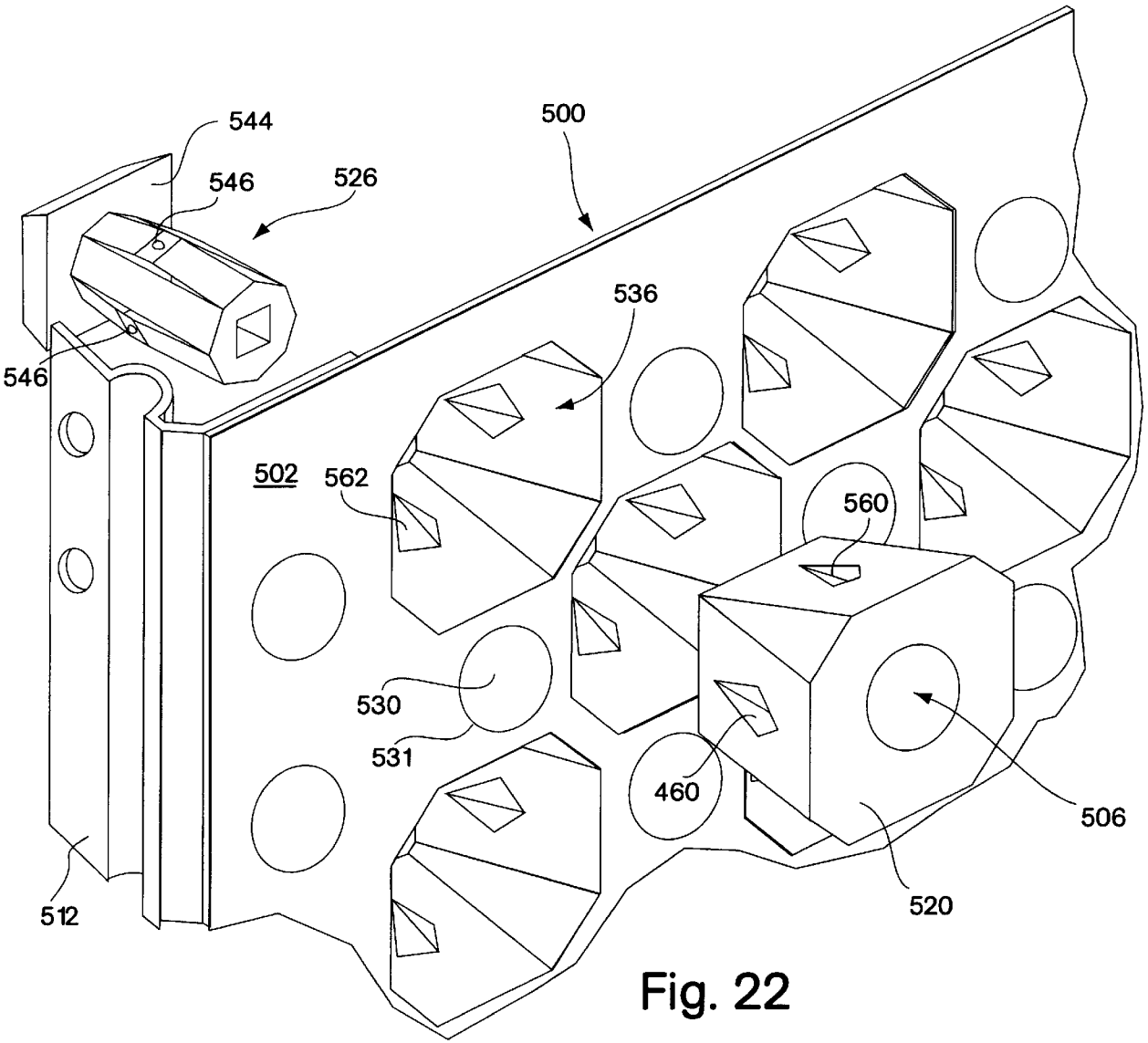
FIG. 22 is an exploded view from the panel of FIGS. 20 and 21 illustrating an insert from the pour side and an oversized plug from the back side of the panel.

Referring now to FIG. 22, a detail of the pour side of panel 500 is illustrated in which insert 520 is shown positioned to be inserted into pyramidical aperture 536 which is in fact the inside surface of the corresponding truncated pyramid 504 which projects rearwardly from the back of sheet 502.

As will be seen, insert 520 is an eight-sided truncated pyramid itself matching the interior of the corresponding truncated pyramid in sheet 502. As will be seen, insert 520 carries an aperture 506 into which is inserted an oversized plug 526 of the type described in FIG. 7, 8 and 9, with the exception that plug 526 carries a cap 544 for limiting the downward movement of the plug into aperture 506 as can be seen in FIG. 23.

Figure 23:
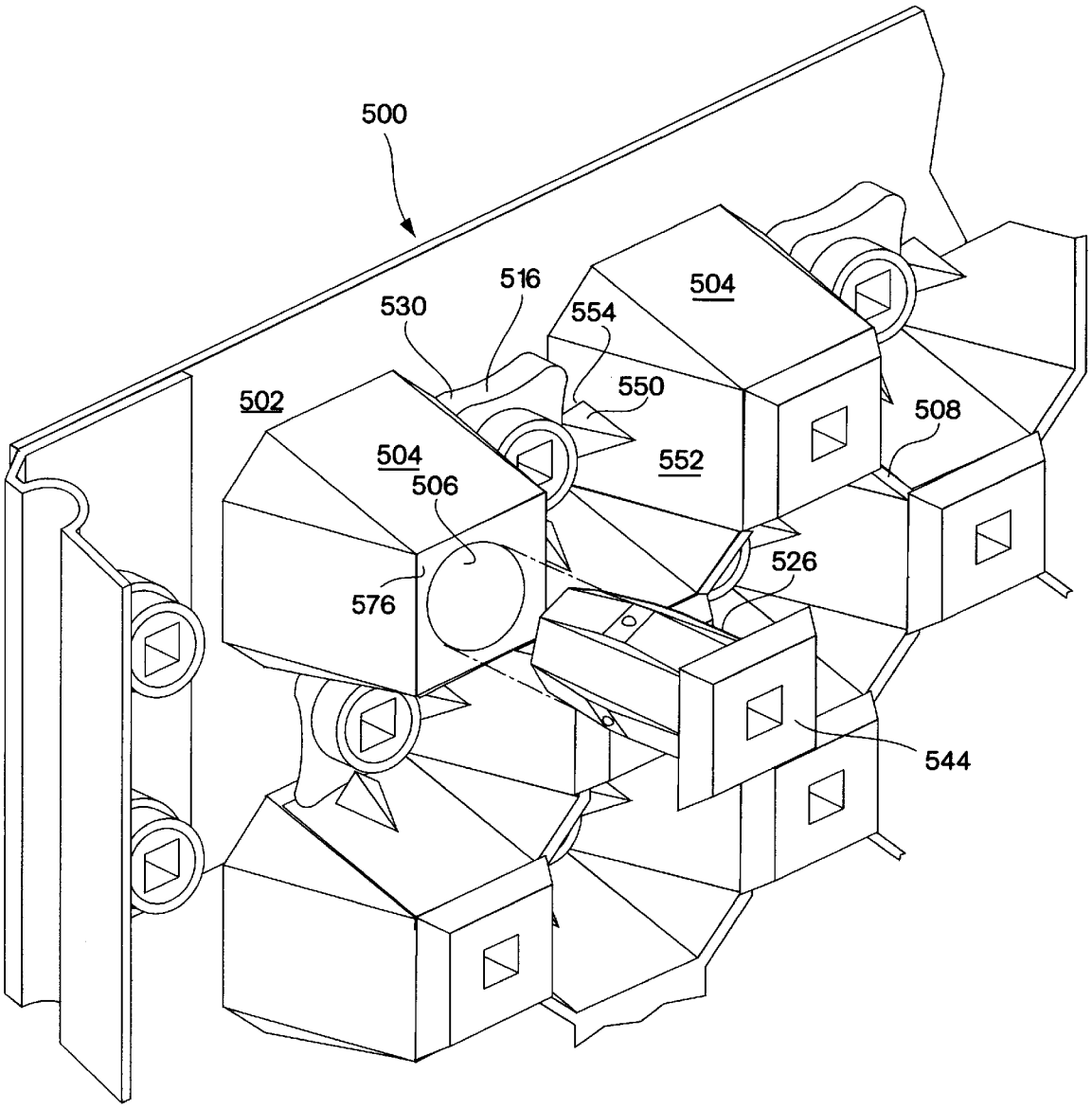
FIG. 23 is an exploded view from the back side of the panel illustrating insertion of the oversized plug.

Also in FIG. 22 is shown the apetures 531 into which plugs 530 of FIG. 23 are inserted.

In addition, there are detents on insert 520 and plug 526 such that when assembled, the elements are captured within the pyramidal structure with the face of the insert being flush with face 524.

In addition, there are detents on insert 520 and on pyramidical aperture 536 such that when insert 520 is inserted into the truncated pyramid 536, it is captured into a position such that the face of insert 520 will be flush with face 524.

Referring now to FIG. 23, the back side of panel 500 is shown carrying a truncated pyramid 504 integral to the surface 502 of this panel. These pyramids can be formed in an initial molding process for sheet 502 in which the sheet and pyramids are formed as one molded panel. The back side of the panel is therefore provided with a number of the aforementioned pyramids, with each of the pyramids carrying an oversized plug 526 capped with a cap 544 which comes to rest on the top surface 546 of the pyramid 504. As will be seen in connection with FIG. 25, oversized plug 526 fits into the aperture 506 of insert 520 which is inserted from the pour side of the panel. What will be seen is that with insert 520 coming through the panel and being locked therein from the pour side and with plug 526 being inserted from the back side, the structure when formed is completely interlocking insofar as the elements are captured within each pyramid.

What can also be seen from FIG. 23 is that plugs 530 are inserted into the apertures 531 of panel 500 and are locked in place via projections 550 which projects outwardly from corresponding surfaces 552 of a corresponding pyramid. What this means is that plug 530 may be pressed into place between adjacent pyramidal structures by virtue of an insertion and twisting act in which the insert passes by projections 550 at channel 554 after which, upon being rotated in place, the insert is captured by projection 550.

Figure 24:
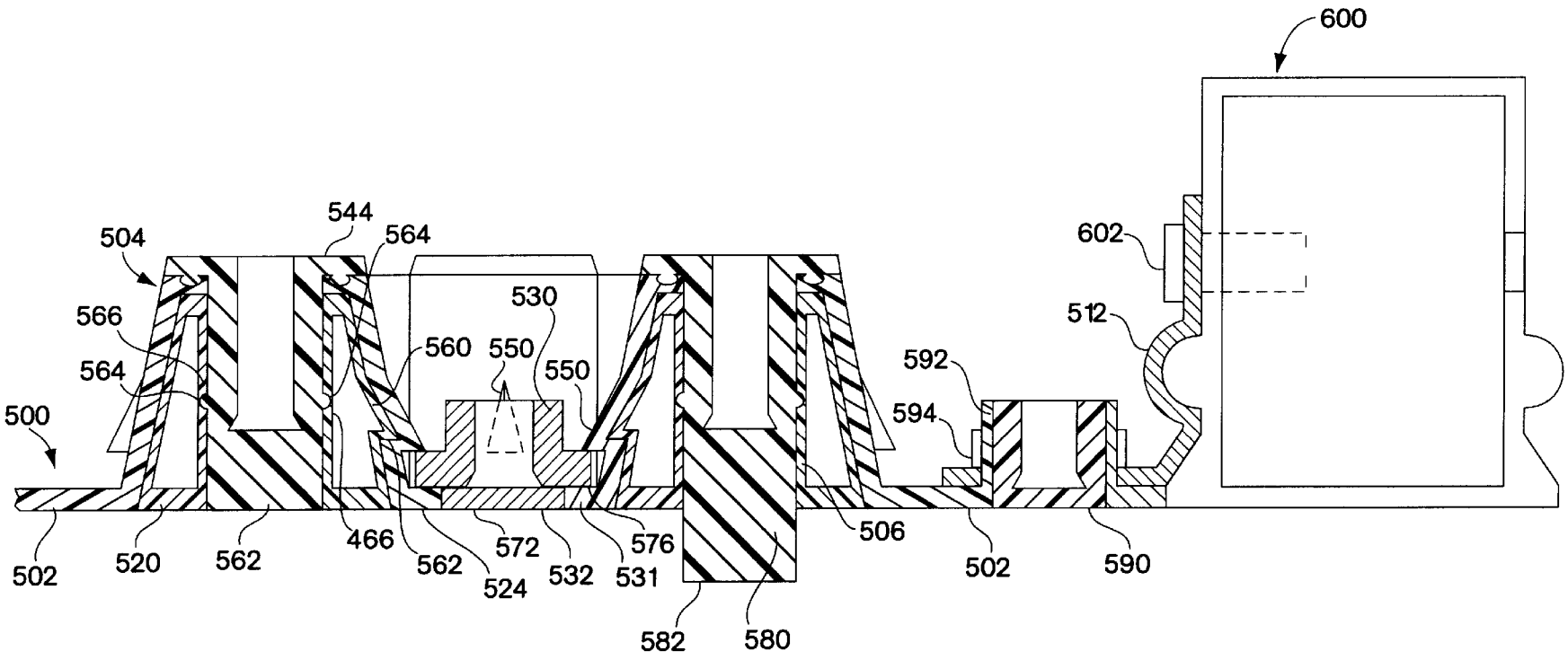
FIG. 24 is a cross-sectional view of the components of the panel illustrating the interlocking inserts and plugs of FIGS. 21, 22 and 23; and, FIG. 25 is a preservative view of a portion of the backside of the panel of FIG. 20 showing the formation of the alternating truncated pyramids.

Referring now to FIG. 24, a cross-sectional view of panel 500 is shown in which pyramids 505 are formed integrally with sheet 502 and are hollow as illustrated. Inserts 520 are likewise hollow having integral outward projections 560 which coact with a ledge and detent structure 562 molded into the surface of the pyramid to provide the aforementioned projection 550, such that insert 520 is locked into place within the corresponding pyramid.

Thereafter, oversized plug 526 is inserted from the other direction into aperture 506 of insert 520, with detents 564 coming to rest in mating apertures 566 in insert 520.

As will be seen, when oversized plug 526 is fully inserted, cap 544 prevents further downward movement of a plug into the corresponding pyramid such that the faces of all of the inserted elements are flush with face 524.

The same is true of plug 530 which has a face 532 which is flush with face 524 as well, having a nose portion 572 projecting into an aperture 531 of sheet 502. A flange portion 576 of plug 530 prevents nose portion 572 from projecting further outwardly from face 524.

It will be appreciated that if required, an oversized plug may extend into the pour from the pour side of the panel. This is illustrated by oversized plug 580 which has a projecting portion 582 which passes through aperture 506 as illustrated.

Likewise, angle 512 may be secured to sheet 502 as illustrated by the utilization of an oversized plug 590 into a collar 592 formed in sheet 502. Here, a nut 594 serves to couple angle 512 to the sheet. Alternatively, angle 512 may be integrally formed with the sheet.

As can be seen, angle 512 is secured to a channel 600 in the manner described hereinbefore by a bolt or plug 602.

Figure 25:
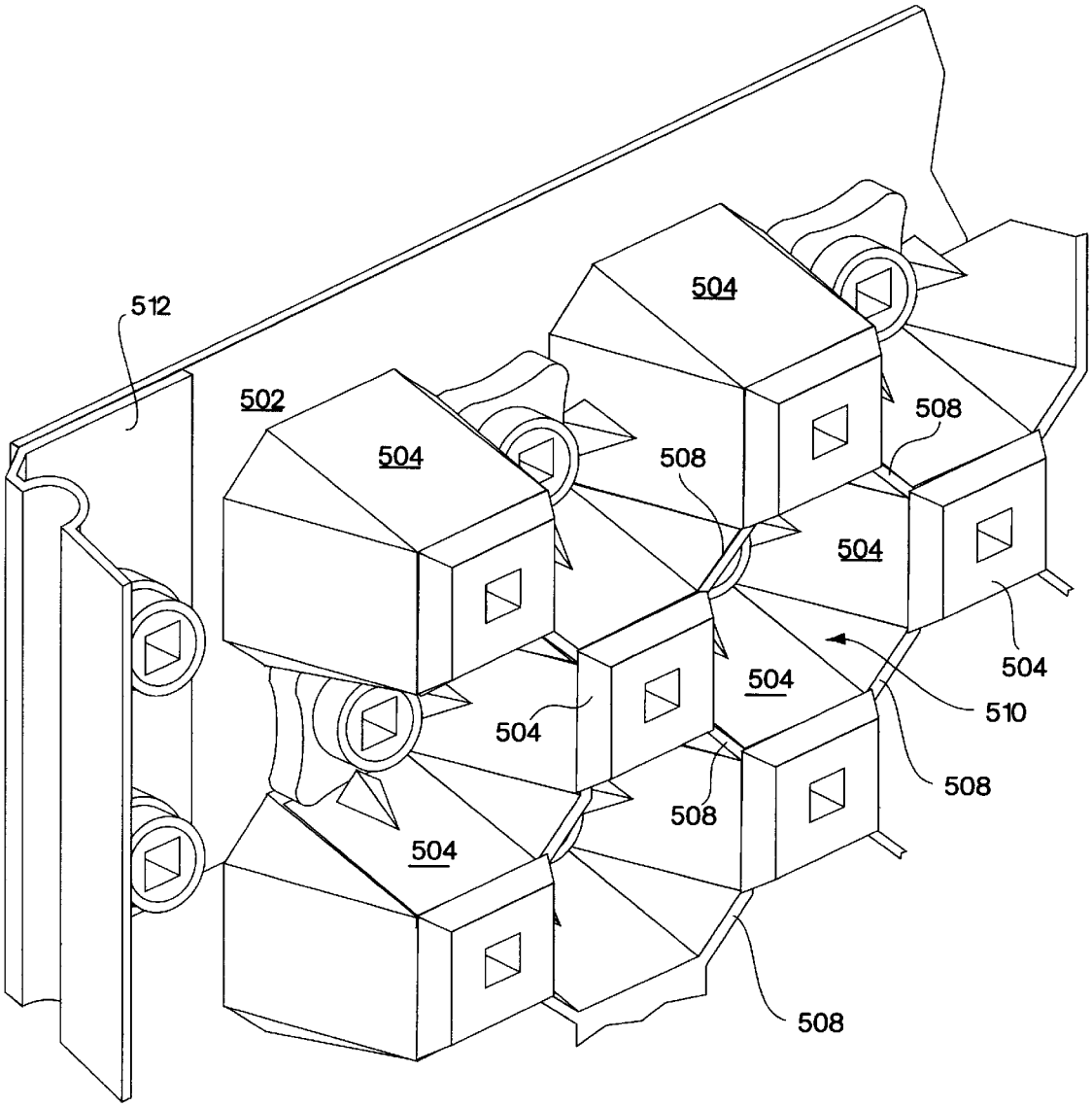

Referring now to FIG. 25, what is shown here in detail is that which is described in connection with FIG. 20, namely, that an array of truncated pyramids 504 all projecting rearwardly when joined by integral ribs 508 form an inverted pyramid 510. The result of this integral structure projecting backwardly from sheet 502 is that an exceptionally light weight rigid and strong panel construction is provided without the requirement of a honeycomb structure. The elements which are inserted into the panel are captured in the panel through locking structures. The array of backwardly-pointed pyramids interspersed with alternating forwardly-pointed pyramids provides for the rigidity of aforementioned honeycomb panel without the necessity of a back sheet. Access is provided so that other structural members can be secured to the panel through apertures provided in either the pyramids, or the inserts between the pyramids such that attachment of framing members to the panel is unaltered in this embodiment.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. In a forming system for molding elements from a settable material for use in the construction of buildings, a light weight panel for use as a wall in a framing system comprising a sheet having a front surface and an array of hollow polygons integrally formed in a back surface thereof so as to project out in a rearward direction from said sheet; and, inserts captured within said polygons, said inserts having surfaces which are flush with the front surface of said sheet such that the front surface of said sheet forms a smooth molding surface.

2. The panel of claim 1 wherein said array is rectilinear.

3. The panel of claim 2 wherein said polygons are pyramids having walls and further including ribs positioned between four adjacent pyramids, each of said ribs having side edges, each side edge secured to a corresponding edge of an adjacent pyramid, four of said ribs and the walls of said four adjacent pyramids forming an inverted pyramid in the space between said four adjacent pyramids.

4. The panel of claim 3 wherein said ribs are formed integral to said sheet during the formation of said sheet.

5. The panel of claim 1 wherein selected ones of said inserts have apertures and further including a plug in each aperture.

6. The panel of claim 5 wherein the end of said plug when inserted in a corresponding aperture has an end surface flush with the front surface of said sheet.

7. The panel of claim 3 wherein an interior wall of said pyramid carries detent receiving means and wherein one of said inserts has an exterior surface, and carries a mating detent on the exterior surface thereof.

8. The panel of claim 5 wherein the aperture in said selected ones of said inserts includes detent receiving means and further including a plug adapted to be inserted into said aperture and having a detent on the surface thereof.

9. The panel of claim 1 wherein said sheet includes apertures between adjacent polygons and further including an apertured insert in an aperture between adjacent polygons.

10. The panel of claim 2 and further including a plug adapted to be positioned in the aperture of said apertured insert.

11. The panel of claim 10 and further including means carried by adjacent polygons to lock said apertured insert into place in the aperture in said sheet into which it is inserted.

12. The panel of claim 1 wherein said polygons are pyramids.

13. The panel of claim 12 wherein said pyramids are truncated.

* * * * *